US009301670B2

(12) United States Patent
Dalsing et al.

(10) Patent No.: US 9,301,670 B2
(45) Date of Patent: Apr. 5, 2016

(54) FLUID CIRCULATION ARRANGEMENT FOR PROVIDING AN INTENSIFIED WASH EFFECT IN A DISHWASHER AND AN ASSOCIATED METHOD

(75) Inventors: Troy A. Dalsing, Sollentuna (SE); David E. House, Greenville, NC (US); Mark D. Montgomery, Greenville, NC (US); Daniel Clay White, Pink Hill, NC (US); Virgil J. Francisco, Ayden, NC (US); Niklas Olson, Stockholm (SE)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 912 days.

(21) Appl. No.: 12/853,728

(22) Filed: Aug. 10, 2010

(65) Prior Publication Data

US 2011/0030742 A1 Feb. 10, 2011

Related U.S. Application Data

(60) Provisional application No. 61/232,539, filed on Aug. 10, 2009.

(51) Int. Cl.
*A47L 15/50* (2006.01)
*A47L 15/16* (2006.01)

(52) U.S. Cl.
CPC ..... *A47L 15/508* (2013.01); *A47L 15/16* (2013.01); *Y10T 29/49826* (2015.01)

(58) Field of Classification Search
USPC ..... 134/56 D, 57 D, 58 D; 211/41.8
See application file for complete search history.

(56) References Cited

U.S. PATENT DOCUMENTS

| | | | |
|---|---|---|---|
| 1,598,352 | A | 8/1926 | Kehoe, Jr. et al. |
| 3,595,253 | A | 7/1971 | Yanez-Pastor |
| 6,431,188 | B1 | 8/2002 | Laszczewski, Jr. et al. |

(Continued)

FOREIGN PATENT DOCUMENTS

| | | |
|---|---|---|
| CN | 101416858 A | 4/2009 |
| DE | 1 252 859 | 10/1967 |

(Continued)

OTHER PUBLICATIONS

Search Report and Written Opinion for International Application No. PCT/US2010/045057, mailed May 23, 2011.

(Continued)

*Primary Examiner* — David Cormier
(74) *Attorney, Agent, or Firm* — Alston & Bird LLP

(57) ABSTRACT

According to embodiments of the present invention, a dishwasher may provide an intensified wash effect. The dishwasher may include a rack defining a bottom and a sidewall, wherein the rack is adapted to receive dishware therein. A dishwashing fluid supply channel may be configured to supply dishwashing fluid to a spray assembly. The spray assembly may comprise at least one nozzle member. Thereby, the spray assembly may be adapted to receive the dishwashing fluid from the dishwashing fluid supply channel and to dispense the dishwashing fluid therethrough. The spray assembly may be coupled to the sidewall of the rack. Further, the nozzle member may be attached to an arm which is moveable between at least a first position wherein the arm is adjacent the sidewall of the rack and a second position wherein the arm is adjacent the bottom of the rack.

22 Claims, 33 Drawing Sheets

(56) References Cited

U.S. PATENT DOCUMENTS

| | | | | |
|---|---|---|---|---|
| 6,612,009 | B1 | 9/2003 | Laszczewski, Jr. et al. | |
| 6,758,227 | B2 | 7/2004 | Lee et al. | |
| 6,786,339 | B2 | 9/2004 | Deiss et al. | |
| 6,869,029 | B2 | 3/2005 | Ochoa, Sr. et al. | |
| 7,055,537 | B2 * | 6/2006 | Elick et al. | 134/180 |
| 7,210,849 | B2 | 5/2007 | Yamazaki et al. | |
| 7,225,818 | B2 | 6/2007 | Kim et al. | |
| 7,331,356 | B2 | 2/2008 | VanderRoest et al. | |
| 7,445,013 | B2 | 11/2008 | VanderRoest et al. | |
| 7,475,696 | B2 | 1/2009 | Vanderroest et al. | |
| 7,523,758 | B2 | 4/2009 | Vanderroest et al. | |
| 7,695,571 | B2 | 4/2010 | Purtilo et al. | |
| 7,754,024 | B2 | 7/2010 | Koch et al. | |
| 2004/0255982 | A1 | 12/2004 | VanderRoest et al. | |
| 2005/0022847 | A1 | 2/2005 | Nito et al. | |
| 2005/0039777 | A1 | 2/2005 | Jerg et al. | |
| 2005/0133070 | A1 * | 6/2005 | Vanderroest | A47L 15/16 134/56 D |
| 2005/0150529 | A1 | 7/2005 | Vanderroest et al. | |
| 2007/0006903 | A1 | 1/2007 | Koch et al. | |
| 2007/0084486 | A1 | 4/2007 | Park et al. | |
| 2007/0235063 | A1 | 10/2007 | Lee et al. | |
| 2009/0056772 | A1 | 3/2009 | Lee | |
| 2009/0178698 | A1 | 7/2009 | Delgado | |
| 2009/0314316 | A1 | 12/2009 | Hall | |
| 2010/0043826 | A1 | 2/2010 | Bertsch et al. | |
| 2010/0101611 | A1 | 4/2010 | Chen et al. | |
| 2010/0116296 | A1 | 5/2010 | Bertsch et al. | |
| 2010/0154846 | A1 | 6/2010 | Vanderroest et al. | |

FOREIGN PATENT DOCUMENTS

| | | | |
|---|---|---|---|
| DE | 31 25 853 | A1 | 4/1983 |
| DE | 296 07 515 UI | | 8/1997 |
| DE | 196 24 891 | A1 | 10/1997 |
| DE | 198 47 151 | | 4/2000 |
| DE | 103 00 501 | A1 | 7/2004 |
| DE | 10 2007 003 894 | A1 | 7/2008 |
| EP | 0 997 100 | A1 | 5/2000 |
| EP | 1 264 570 | A1 | 12/2002 |
| EP | 1 266 604 | A2 | 12/2002 |
| EP | 1 568 304 | A2 | 8/2005 |
| EP | 1 676 520 | A2 | 7/2006 |
| EP | 1 847 207 | A2 | 10/2007 |
| FR | 2 544 606 | A1 | 10/1984 |
| JP | 11-76127 | A | 3/1999 |
| WO | WO-2009/004034 | A1 | 1/2009 |

OTHER PUBLICATIONS

The International Bureau of WIPO, International Preliminary Report on Patentability for International Application No. PCT/US2010/045057, issued Feb. 14, 2012, 7 pages, Switzerland.

* cited by examiner

FLUID CIRCULATION ARRANGEMENT FOR PROVIDING AN INTENSIFIED WASH EFFECT IN A DISHWASHER AND AN ASSOCIATED METHOD

CROSS REFERENCE TO RELATED APPLICATIONS

This application claims priority to U.S. Provisional Application No. 61/232,539, filed Aug. 10, 2009, which is incorporated by reference herein in its entirety.

BACKGROUND OF THE INVENTION

1. Field of the Invention

Embodiments of the present invention are generally related to fluid circulation arrangements in a dishwashing appliance and, more particularly, to fluid circulation arrangements and methods for providing a concentrated and/or intensified wash effect in a dishwasher.

2. Description of Related Art

A dishwasher typically includes a tub portion for receiving dishware to be washed, wherein the tub portion defines a front or forward opening having a door member pivotably engaged therewith for sealing the opening. Often, the tub portion defines an interior space substantially in the form of a cube or elongate cube. However, dishwashing fluid, such as water, is normally sprayed or otherwise distributed over the contents of the tub portion by centrally (and horizontally) disposed rotating spray arms. As such, the dishwashing fluid is generally distributed in a substantially cylindrical configuration within the tub portion to achieve broad coverage and impingement of the dishwashing fluid on the dishware therein.

However, in some testing regimens serving bowls that include/represent baked on food soils may receive low scores since, in many areas of the dishwasher rack (within the tub portion) the jet intensity and dishwashing fluid coverage from the spray arms may not be sufficient to break up and remove heavy or baked-on food soils. In this regard, there may be generally three impediments to effective removal of heavy or baked-on soils: 1) there are baked-on or heavy food soils that are very difficult, in any event, to remove using conventional spray jets from the spray arms during a typical or extended dish washing cycle. To be able to remove these soils, an increase in pressure, time, coverage, and/or temperature may be beneficial. However, combinations of these parameters spread throughout the entire dishwasher and wash cycle may require a disproportional amount of energy to be consumed to clean the few dishware items with baked-on or heavy soils, versus the remainder of the dishware items wherein the majority of the soils may typically range from light to moderate in magnitude and/or cleaning difficulty; 2) a typical dishwasher spray arm may be designed to cover and clean all types of dishware that is dispersed within the dishwasher rack(s). To maximize the spray jet impingement on the soiled surface of such dishware, the dishware may be placed in the rack(s) in a horizontal orientation to maximize exposure to the dishwashing fluid dispensed from the typical horizontally-disposed rotating spray arm configuration. Such dishware, which may be large in usable surface area, would severely limit the amount of dishware items that could be loaded in the rack, if such items are placed in a horizontal orientation; and 3) due to the nature of baked-on or heavy soils, such soiled dishware may require specialized provisions for more concentrated and intensified exposure to the dishwashing fluid to enable such soils to be removed therefrom.

As such, there exists a need for an apparatus and associated method for concentrating and/or intensifying the distribution of dishwashing fluid in a dishwasher, whether selectively or on-demand, to achieve "focused" cleaning power on a particular area within the tub portion, in addition to or in the alternative to conventional spray arm technology, and possibly in the alternative to some "zone cleaning" schemes.

BRIEF SUMMARY OF THE INVENTION

The above and other needs are met by embodiments of the present invention which, in one aspect, provides a fluid circulation arrangement for circulating dishwashing fluid within a tub portion of a dishwasher, wherein the tub portion including a plurality of walls defining a forward opening. Such a fluid circulation arrangement comprises a rack disposed about a lower end of the tub portion and adapted to receive dishware therein. A dishwashing fluid supply conduit is disposed about and is configured to extend laterally across the lower end of the tub portion. A spray device is operably engaged with one of the rack and the laterally-extending dishwashing fluid supply conduit so as to be supported thereby. The spray device is adapted to receive the dishwashing fluid from the laterally-extending dishwashing fluid supply conduit and to dispense the dishwashing fluid therefrom through at least one nozzle member, so as to provide at least one of a concentrated wash effect and an intensified wash effect at a selected disposition within the tub portion.

The spray device is configured to provide an intensified and/or concentrated wash effect via one or more fixed, moving, rotating, pulsing, gyrating, oscillating, vortex, or random spray pattern fluid jets for removing soils from the dishware placed in a selected disposition within a dish rack within the tub portion. By directing such particular, dedicated spray devices and associated nozzle members toward a dedicated area of the rack, one or more selectable wash cycles can be configured to particularly include parameters for effectuating the disclosed fluid circulation arrangement so as to effectively clean heavy and/or baked-on soils from certain dishware placed in the tub portion, while minimizing or eliminating the direction of such capabilities to other areas within the tub portion of the dishwasher having dishware with light or moderate soil levels, thereby reducing or minimizing dishwashing fluid pressure requirements, operational noise levels, and energy consumption. Further, implementation of a movable or fixed arm for supporting the spray device, in conjunction with a particularly configured support member (nozzle head) and one or more particularly configured nozzle members, further allows the discharged/distributed dishwashing fluid to be concentrated/intensified, as necessary, to the dedicated area within the tub portion from different directions/orientations.

In a further embodiment a dishwasher is provided wherein the dishwasher comprises a rack defining a bottom and at least one sidewall, wherein the rack is adapted to receive dishware therein. The dishwasher also includes a dishwashing fluid supply channel configured to supply a dishwashing fluid, and a spray assembly coupled to the sidewall of the rack. The spray assembly includes at least one nozzle member adapted to receive the dishwashing fluid from the dishwashing fluid supply channel and to dispense the dishwashing fluid therefrom.

In one aspect, the spray assembly is coupled to the sidewall so as to be supported thereby. The spray assembly may further comprise at least one attachment member configured to couple the spray assembly to the sidewall of the rack. Further, the spray assembly may comprise a fluid connector configured to couple the spray assembly to the dishwashing fluid supply channel so as to provide fluid communication therebetween. Additionally, the rack may be moveable between a loading position at which the spray assembly is decoupled from the dishwashing fluid supply channel and an operating position at which the spray assembly is coupled to the dishwashing fluid supply channel. Also, the dishwasher may further comprise a valve configured to control supply of the dishwashing fluid to the nozzle member.

The spray assembly may further comprise an arm coupled to the nozzle member. The arm may be moveable with respect to the rack and can be various shapes and configurations (e.g., Y-shaped). Further, the arm may be configured to rotate about a first axis between a first position wherein the nozzle member is directed substantially horizontally and a second position wherein the nozzle member is directed substantially vertically. In one aspect, the spray assembly comprises a plurality of arms each rotatable with respect to the rack about the first axis and each comprising at least one respective nozzle member. The arm may comprise a bend configured to direct the nozzle member away from a center of the bottom of the rack in the second position. The dishwasher may further comprise a valve configured to control the supply of dishwashing fluid to the nozzle member, wherein the valve is configured to be closed when the arm is in the first position and open when the arm is in the second position. Also, the arm may be further configured to rotate about a second axis which is substantially perpendicular to the first axis such that the nozzle member may be directed towards or away from the rack in the first position and/or the second position. The arm may comprise a first section configured to rotate about the first axis and a second section configured to rotate about the second axis. Additionally, the spray assembly may comprise a manifold coupled to the sidewall to which a plurality of nozzle members are coupled. The manifold may be positioned adjacent to the sidewall such that the nozzle members extend at least partially through the sidewall. Further, a spray arm may be positioned adjacent the bottom of the rack, wherein the spray arm is configured to receive the dishwashing fluid and to dispense the dishwashing fluid in a first wash zone, and wherein the spray assembly is configured to dispense the dishwashing fluid in a second wash zone, wherein the second wash zone differs from the first wash zone in position and/or intensity.

In a further embodiment a dishwasher comprises a rack defining a bottom and at least one sidewall, wherein the rack is adapted to receive dishware therein. The dishwasher further includes a dishwashing fluid supply channel configured to supply a dishwashing fluid, and a spray assembly adapted to receive the dishwashing fluid from the dishwashing fluid supply channel and to dispense the dishwashing fluid therefrom through at least one nozzle member. In addition, the spray assembly includes an arm coupled to the nozzle member and moveable between at least a first position wherein the arm is adjacent the sidewall of the rack and a second position wherein the arm is adjacent the bottom of the rack. The spray assembly may be coupled to the dishwashing fluid supply channel so as to be supported thereby, and/or the spray assembly may be coupled to the rack so as to be supported thereby. The nozzle member may be directed substantially horizontally in the first position and wherein the nozzle member is directed substantially vertically in the second position. Further, the arm may be configured to releasably engage a base member in the first position. Also, the arm and the base member may define a substantially planar surface in the first position.

In a further embodiment a method of assembling a dishwasher is provided. The method may comprise providing a dishwasher, wherein the dishwasher includes a rack defining at least one sidewall and a bottom that is adapted to receive dishware therein. The dishwasher also includes a dishwashing fluid supply channel configured to supply a dishwashing fluid. The method further includes coupling a spray assembly to the sidewall of the rack, wherein the spray assembly includes at least one nozzle member adapted to receive the dishwashing fluid from the dishwashing fluid supply channel and to dispense the dishwashing fluid therefrom.

In an additional embodiment a method of assembling a dishwasher comprises providing a dishwasher, wherein the dishwasher includes a rack defining a bottom and at least one sidewall that is adapted to receive dishware therein. The dishwasher also includes a dishwashing fluid supply channel configured to supply a dishwashing fluid, a spray assembly adapted to receive the dishwashing fluid from the dishwashing fluid supply channel and to dispense the dishwashing fluid therefrom through at least one nozzle member, and an arm coupled to the nozzle member. The method further includes operably engaging the arm with the dishwasher such that the arm is moveable between at least a first position wherein the arm is adjacent the sidewall of the rack and a second position wherein the arm is adjacent the bottom of the rack.

As such, aspects of the present invention provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 24A:
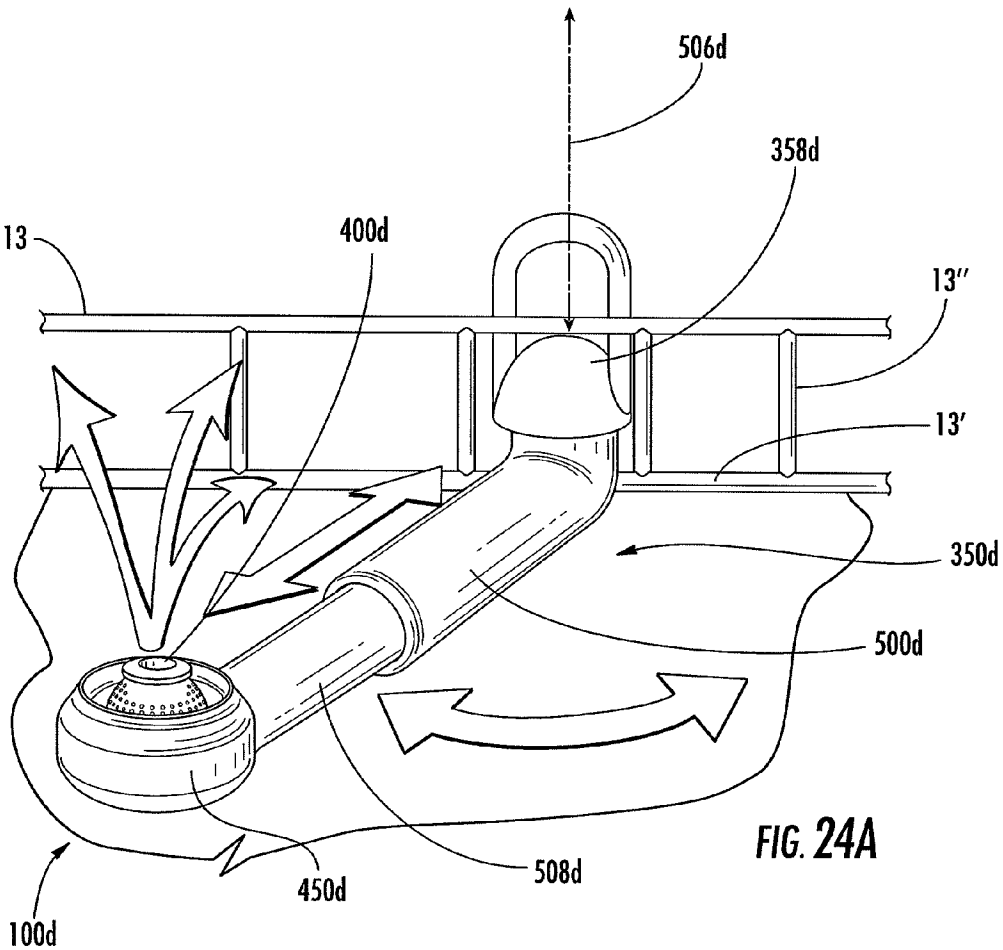
Figure 24B:
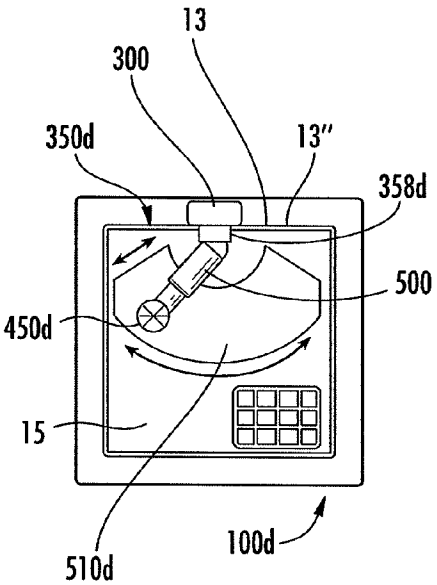
Figure 25:
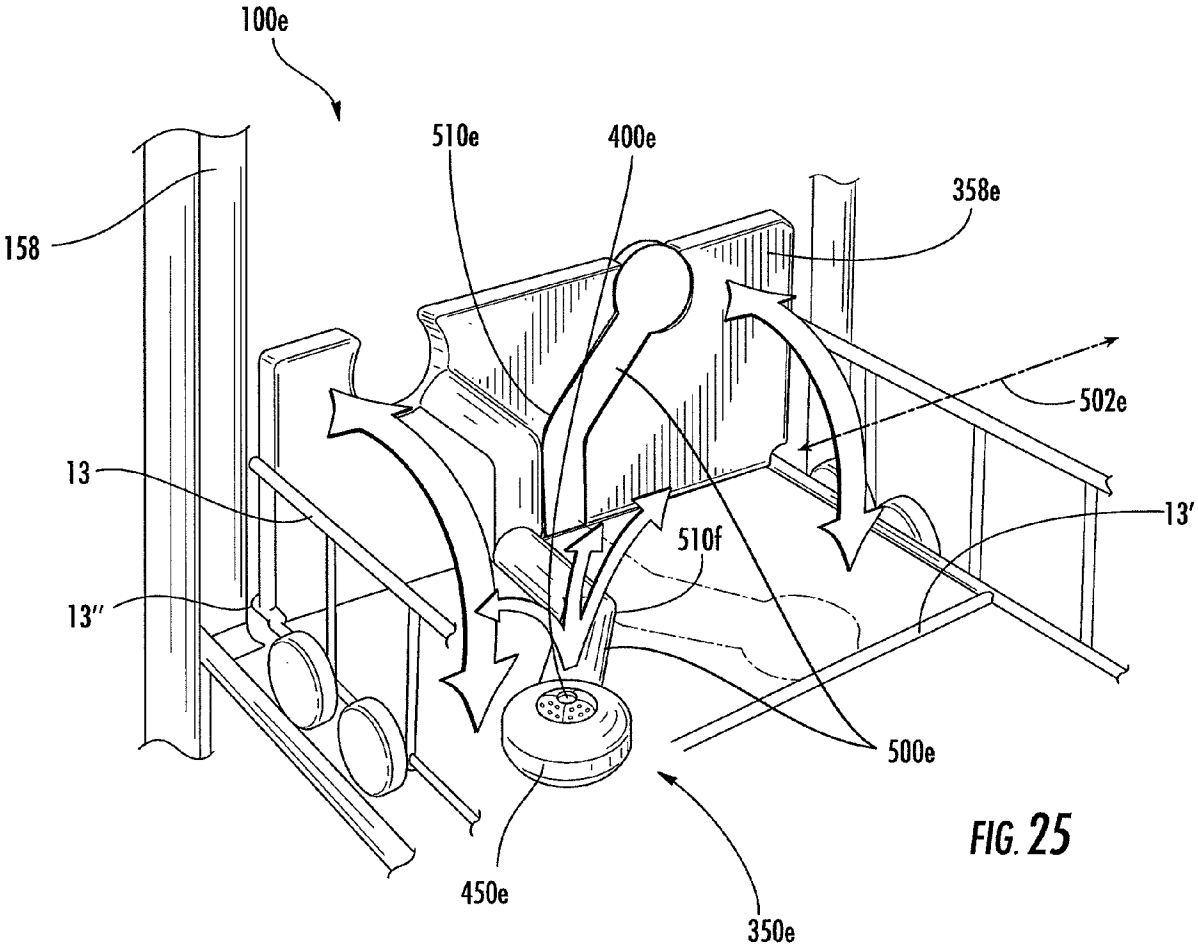
Figure 26:
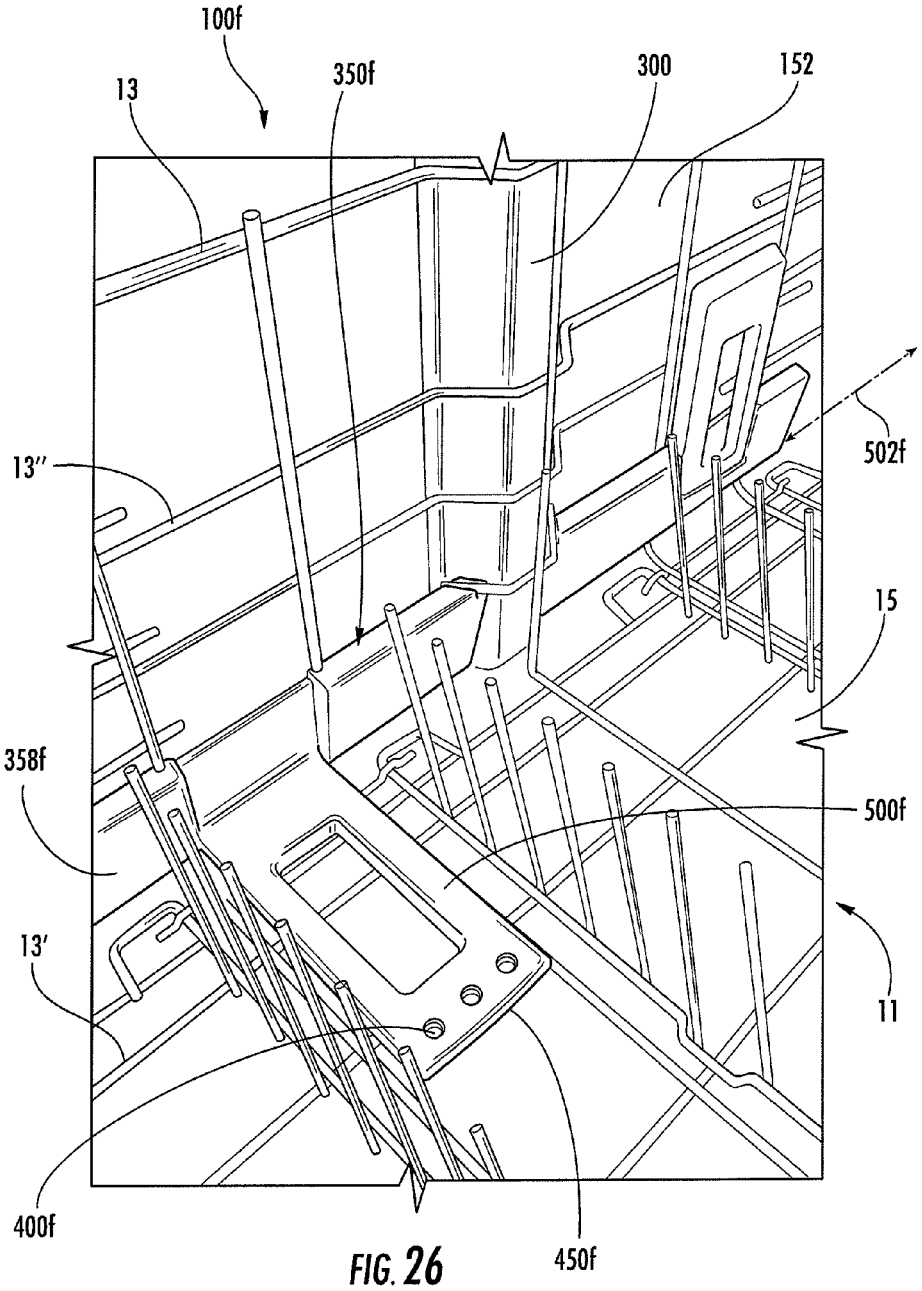
Figure 27:
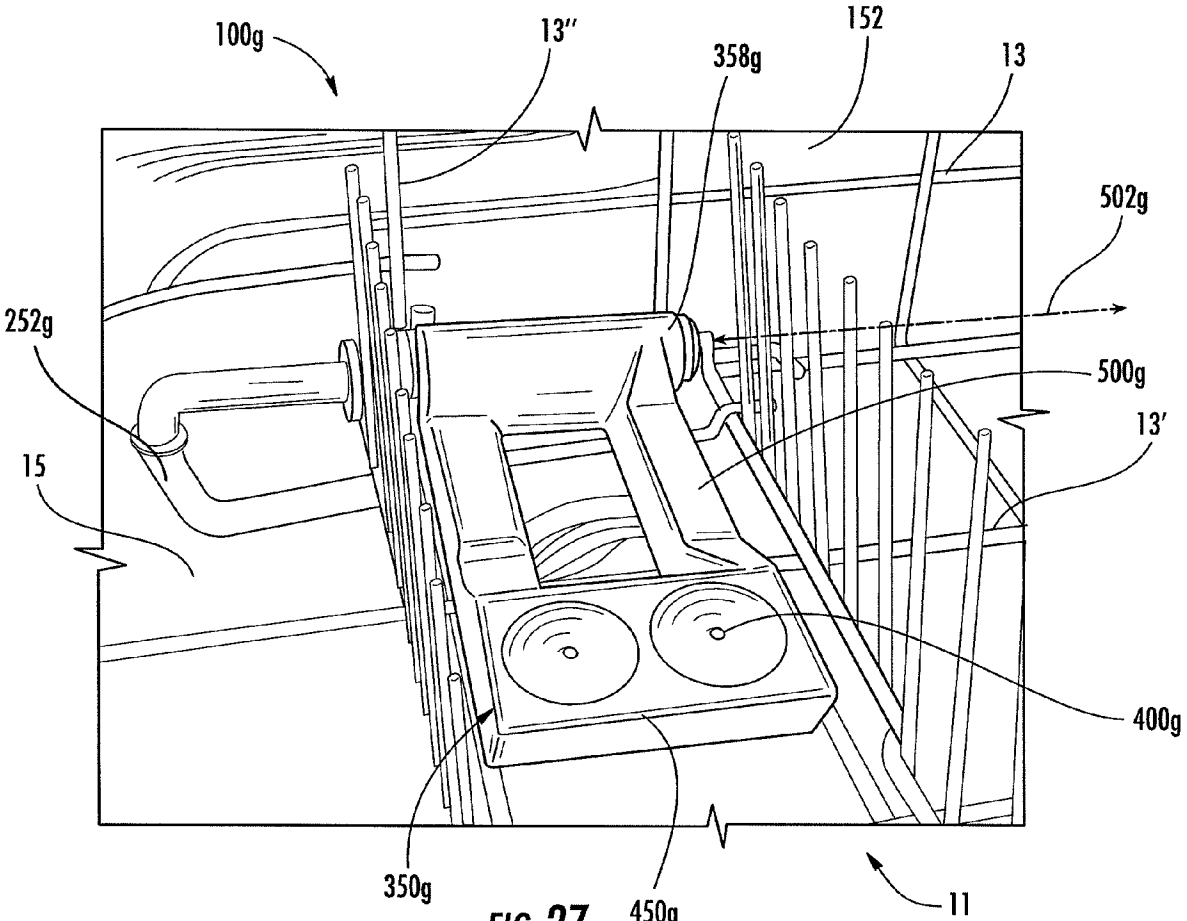
Figure 28:
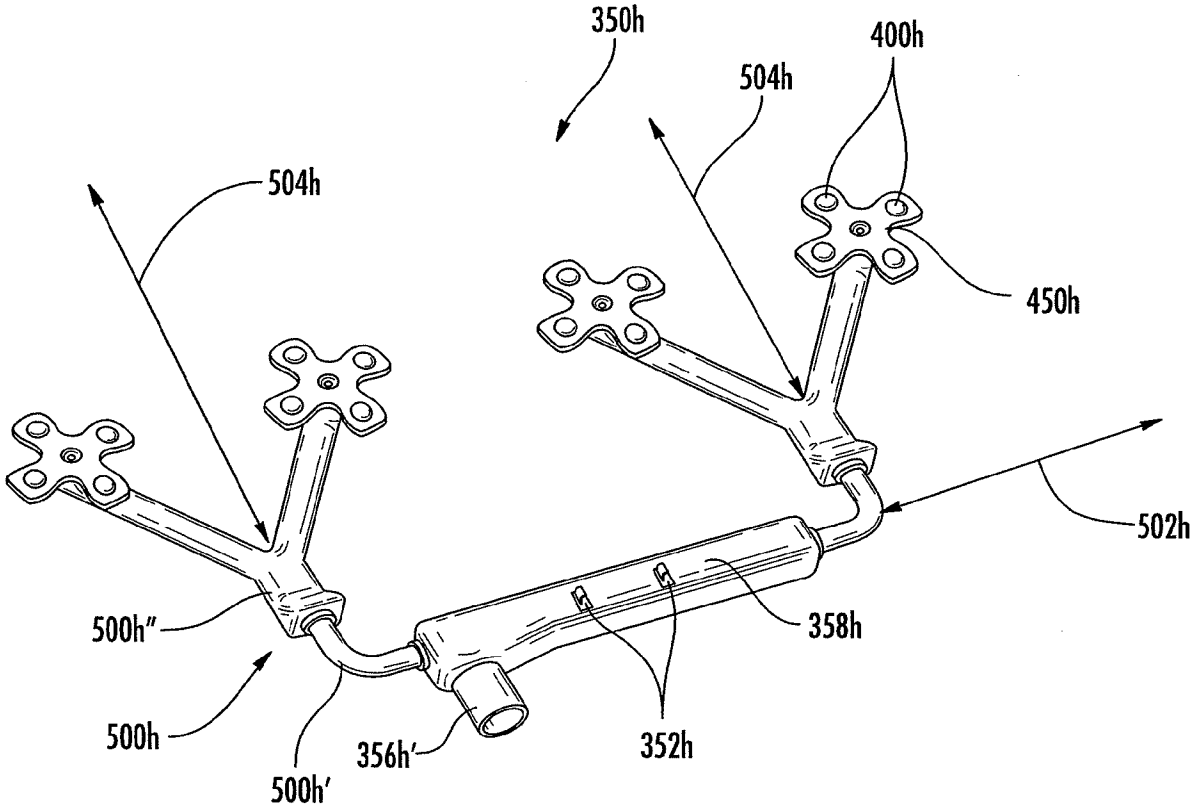
Figure 29:
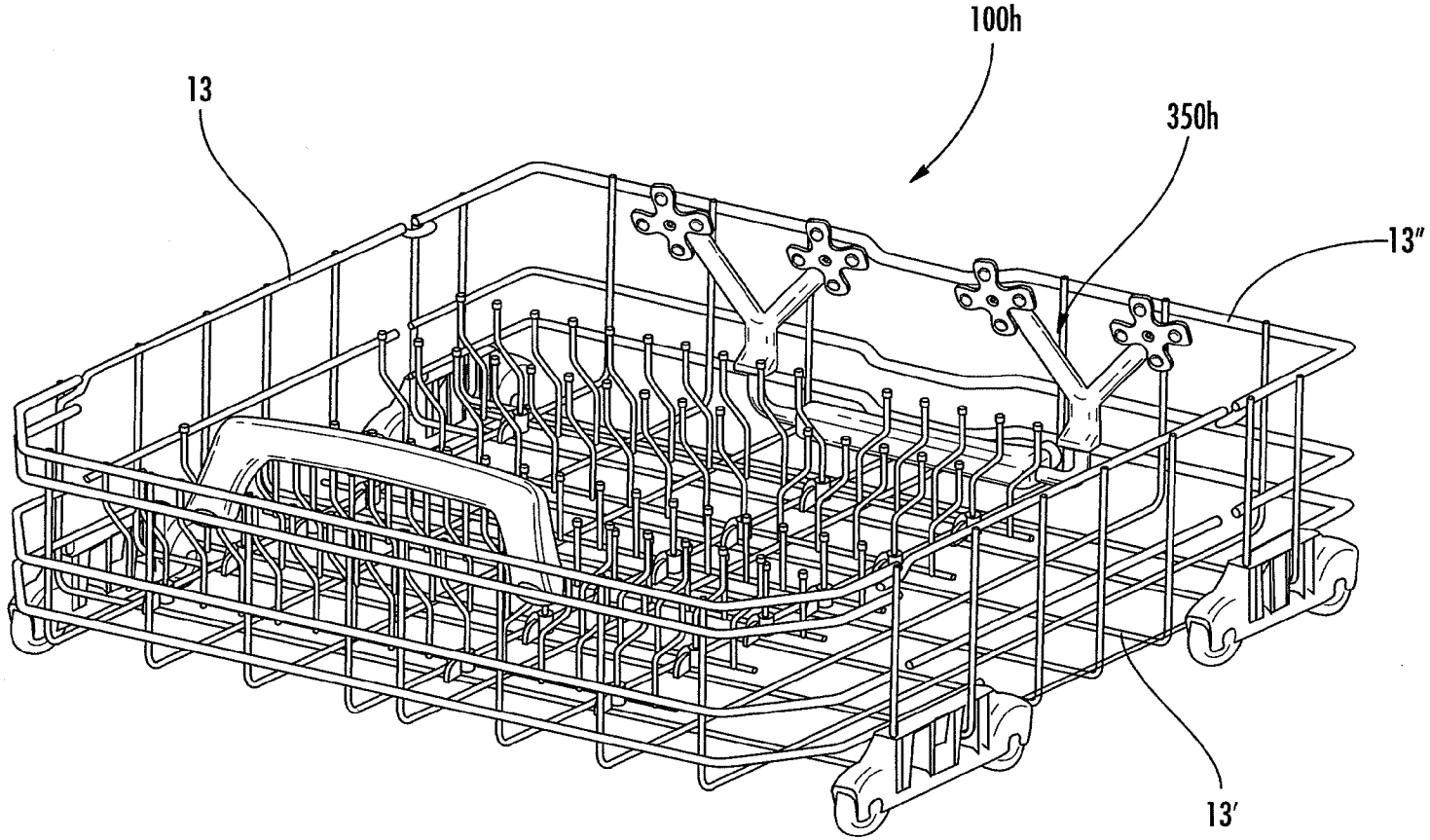
Figure 30:
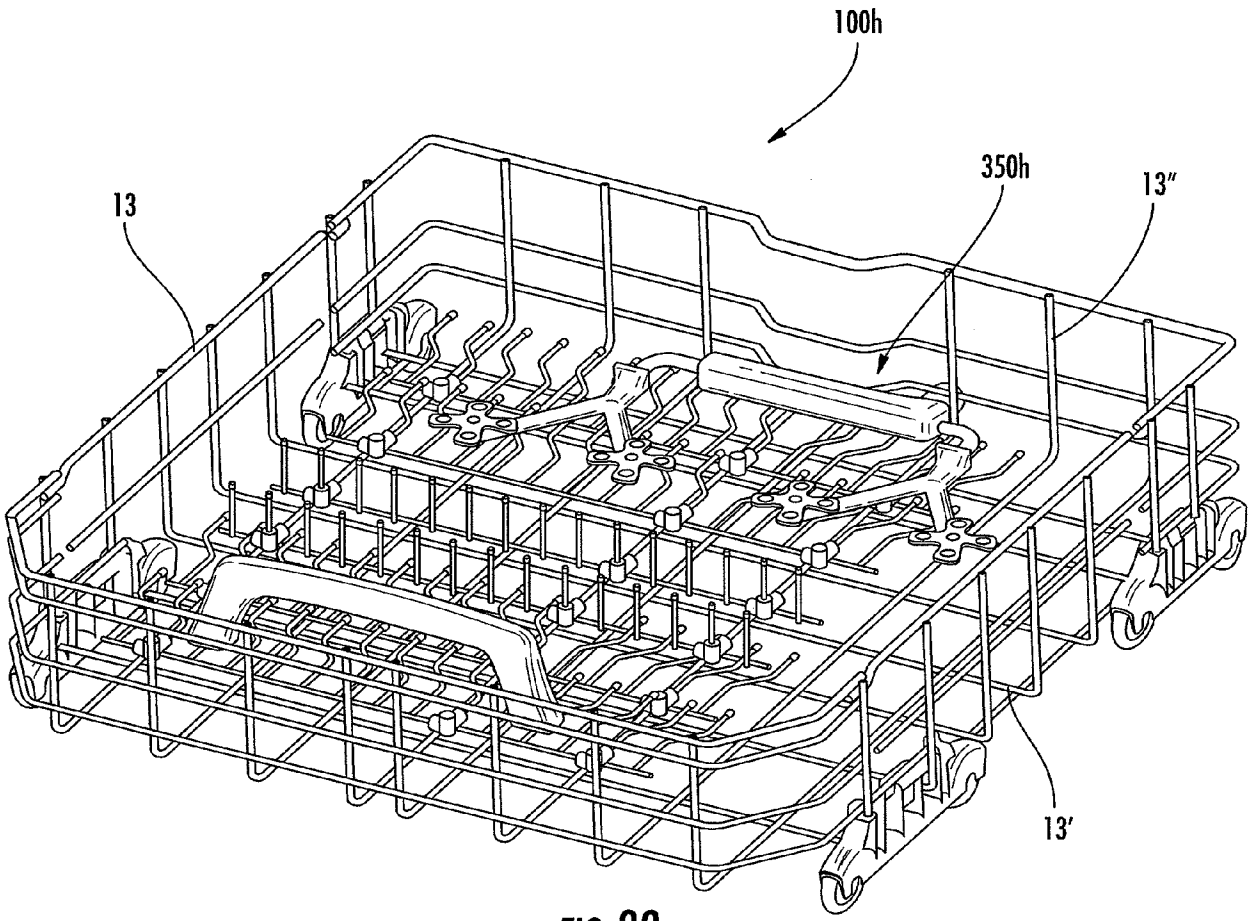

FIGS. 24A-B illustrate views of a fluid circulation arrangement according to a fourth embodiment of the present invention, wherein the spray assembly comprises an arm which is rotatable and extensible;

FIG. 25 illustrates a fluid circulation arrangement according to a fifth embodiment of the present invention, wherein the spray assembly comprises an arm configured to rotate with respect to the rack;

FIG. 26 illustrates a fluid circulation arrangement according to a sixth embodiment of the present invention, wherein the arm is configured to releasably engage a base member;

FIG. 27 illustrates a fluid circulation arrangement according to a sixth embodiment of the present invention, wherein the spray assembly is supplied dishwashing fluid by a flexible hose; and FIGS. 28-30 illustrate a fluid circulation arrangement according to a seventh embodiment of the present invention, wherein the spray assembly comprises two arms configured to rotate with respect to the rack.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
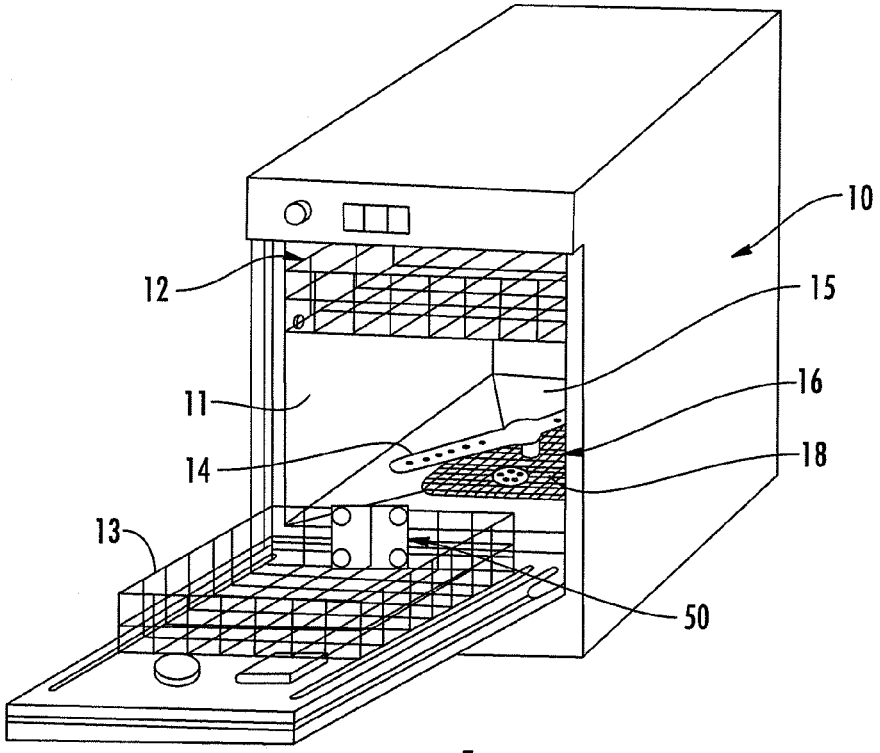
FIG. 1 illustrates a dishwasher according to an embodiment of the invention.

FIG. 1 shows an example embodiment of a dishwasher 10. The dishwasher 10 may be provided with a tub portion 11 in which dishware is inserted on an upper 12 and a lower 13 dish rack. In the tub portion 11 there may be one or more upper rotating spray arms (not shown) and a lower rotating spray arm 14 that direct the circulating dishwashing fluid through spray nozzles towards the dishware which is placed on the racks 12, 13. The circulating dishwashing fluid may fall down on the bottom wall 15 of the tub portion 11 and be directed towards a filter arrangement 16 which may comprise a filter plate 18 and a pump for redistribution of the dishwashing fluid to the spray arms. As explained in further detail below, the dishwasher 10 includes a fluid circulation arrangement 50 comprising a spray assembly configured to provide an intensified and/or concentrated wash effect. Thus, the fluid circulation arrangement may be configured to provide a focused spray zone in addition to, or alternatively of, the spray zones provided by the spray arms 14.

FIGS. 2-9 illustrate a first embodiment of a fluid circulation arrangement for a dishwasher according to one aspect of the present invention, indicated generally by the numeral 100*a*. The fluid circulation arrangement 100*a* is configured to circulate dishwashing fluid within the tub portion 11 of the dishwasher, wherein the tub portion 11 generally includes a plurality of walls (e.g., sides 152, top 154 and bottom 15) cooperating to define a forward opening 158. Disposed within a lower end of the tub portion 11 is a rack 13 adapted to receive dishware therein. The rack 13 may comprise a bottom 13' and one or more sidewalls 13" which may be formed from interconnected horizontal and vertical wires. A dishwashing fluid supply conduit 250*a* may also be disposed about the lower end of the tub portion 11, wherein the dishwashing fluid supply conduit 250*a* may be further configured to extend laterally across the lower end of the tub portion 11, adjacent to the bottom wall and/or one of the side walls thereof. Various other configurations may be employed in positioning the dishwashing fluid supply conduit 250*a* as may be understood by one having skill in the art.

In some instances, the dishwashing fluid supply conduit 250*a* may be configured to operably engage a dishwashing supply channel such as a main dishwashing fluid supply channel 300, which may extend vertically along a rear wall of the tub portion 11, so as to receive the dishwashing fluid therefrom and/or be supported thereby. In such instances, the dishwashing fluid may be directed to the dishwashing fluid supply conduit 250*a* by a main circulation pump (not shown) of the dishwasher configured to supply the dishwashing fluid to the main dishwashing supply channel 300. A valve such as a diverter valve (not shown) may also be implemented, as necessary or desirable, between the main circulation pump and the dishwashing fluid supply conduit 250 or within a spray assembly 350*a*, which will be described below, to allow the dishwashing fluid to be selectively directed to the spray assembly 350*a* or the nozzle member 400*a*, respectively. In one embodiment, the valve is configured to divert water to the spray assembly 350*a* and upper spray arms independently of the lower spray arm 14, although water could be supplied to the spray assembly 350*a*, upper spray arm(s), and/or lower spray arm 14 in additional embodiments. In other instances, however, the dishwashing fluid supply conduit 250 may be operably engaged with a dedicated supply pump (not shown), separate and distinct with respect to the main circulation pump, so as to receive the supply of dishwashing fluid therefrom.

In one embodiment, a spray assembly, generally indicated as element 350*a*, may comprise the dishwashing fluid supply conduit 250, wherein the spray assembly 350 is further configured to receive the dishwashing fluid through the dishwashing fluid supply conduit 250 and to dispense the dishwashing fluid therefrom through at least one nozzle member 400 associated therewith, so as to provide at least one of a concentrated wash effect and an intensified wash effect at a selected disposition within rack 13. The spray assembly 350 may be configured to dispense the dishwashing fluid in a second wash zone, wherein the second wash zone differs from a first wash zone, at which the spray arm 14 dispenses the dishwashing fluid, in position and/or intensity. In some embodiments the fluid supply conduit 250 may be supported by a dishwashing supply channel such as the main dishwashing supply channel 300 such that the spray assembly is ultimately supported by the dishwashing supply channel.

In the embodiment of the fluid circulation arrangement 100*a* illustrated in FIGS. 2-9, the dishwashing fluid supply conduit 250*a* is positioned such that each spray assembly 350*a* directs fluid up through a bottom 13' of the rack 13 at the dishware. By positioning the fluid supply conduit 250*a* and spray assemblies 350*a* in this manner, the rack 13 may be generally positioned above the fluid supply conduit 250*a* and spray assemblies 350*a* such that the spray assemblies 350*a* may come into close proximity with the dishes to provide improved washing functionality. Some embodiments may implement a single nozzle member 400*a*, while other embodiments may implement a plurality of nozzle members 400*a*. As such, for brevity and without intending to be limiting, the "at least one nozzle member 400*a*" may also be referred to herein as "nozzle member 400*a*" for indicating one or more of such nozzle members 400*a*, as will be appreciated by one skilled in the art.

Figure 2:
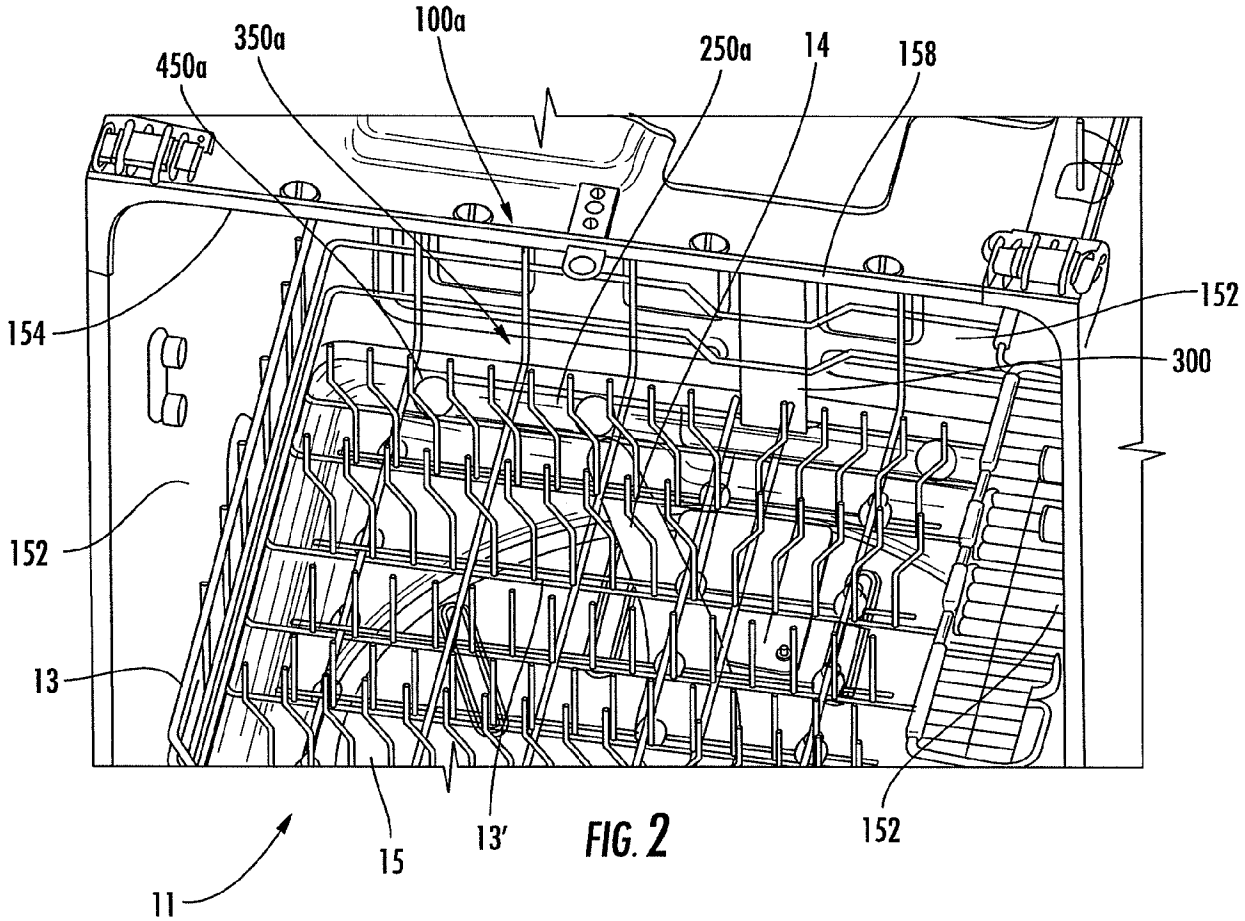
FIGS. 2-9 illustrate various views of a fluid circulation arrangement according to a first embodiment of the present invention, wherein a spray assembly is supported by a dishwashing fluid supply channel.
Figure 3:
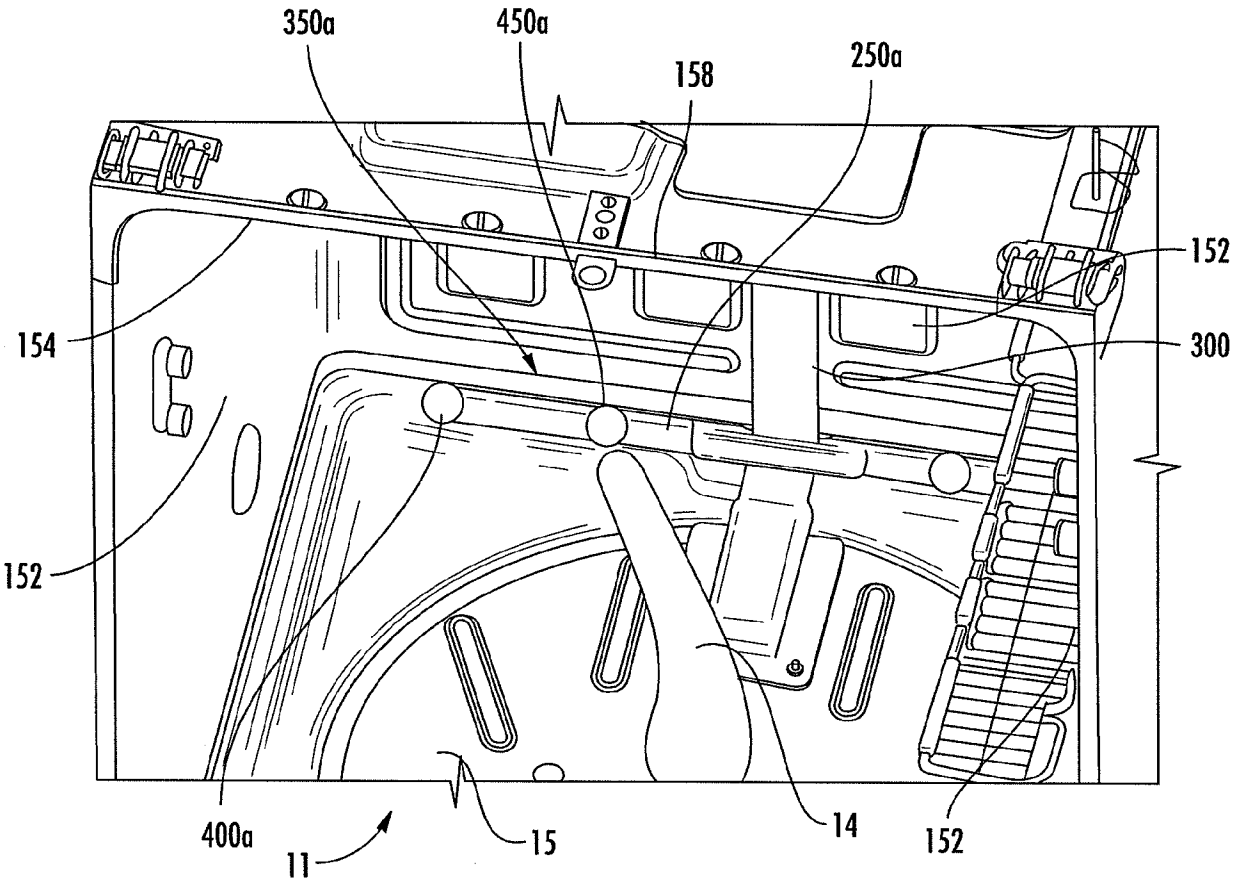
Figure 4:
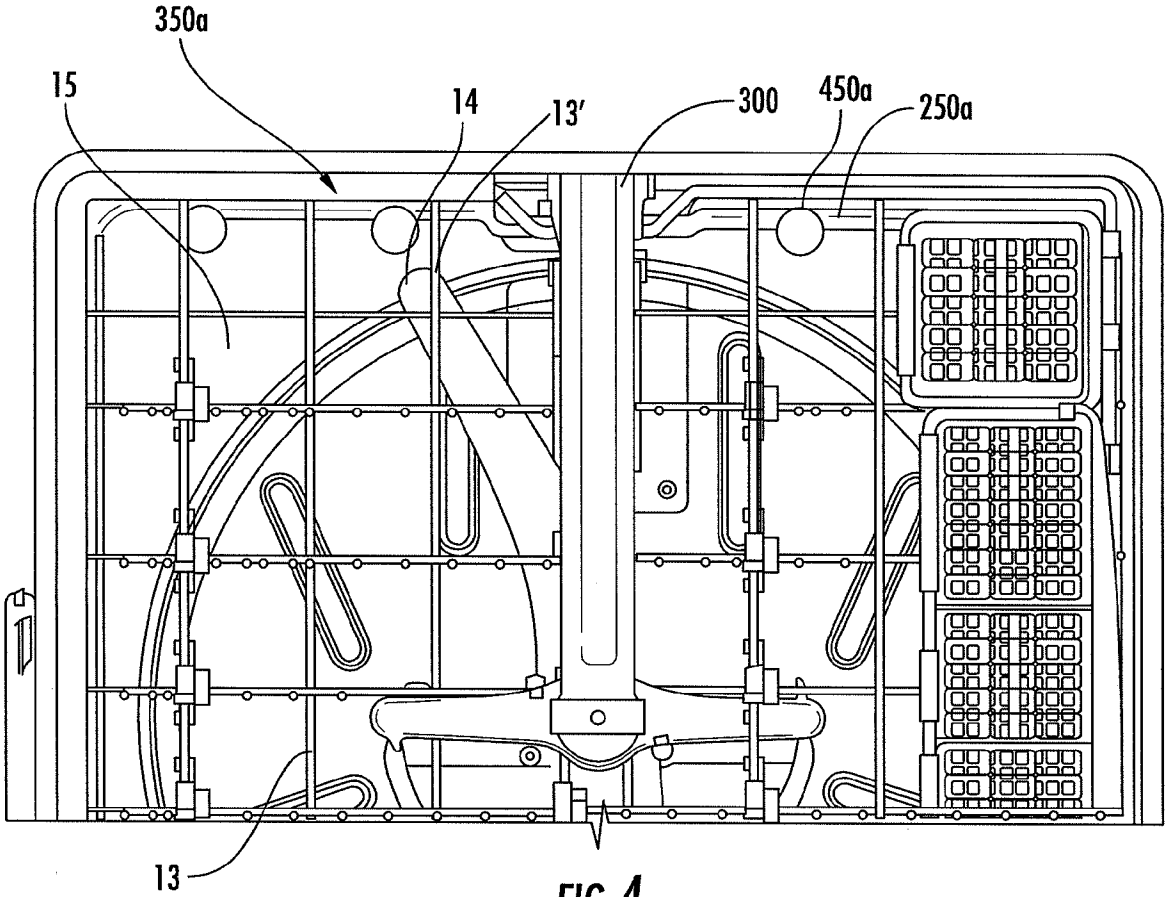
Figure 5:
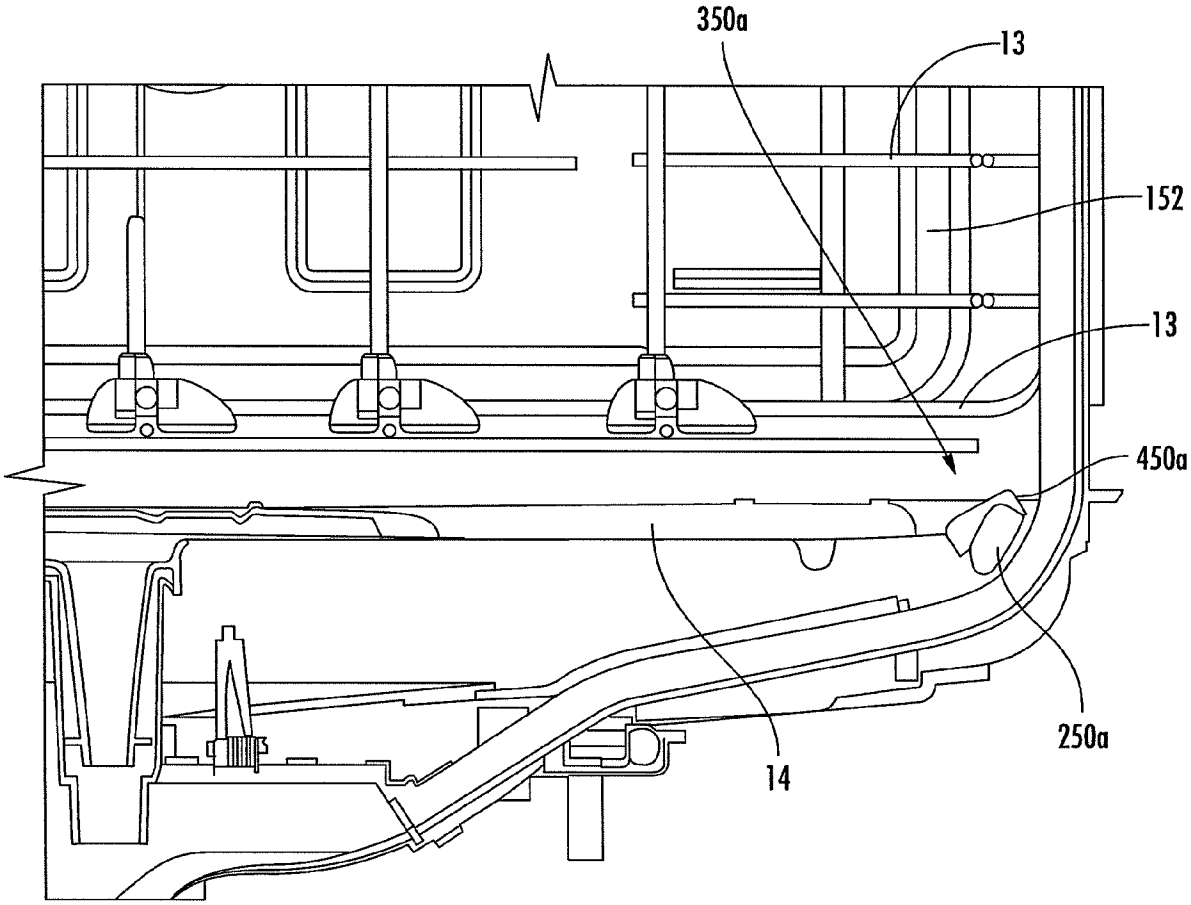
Figure 6:
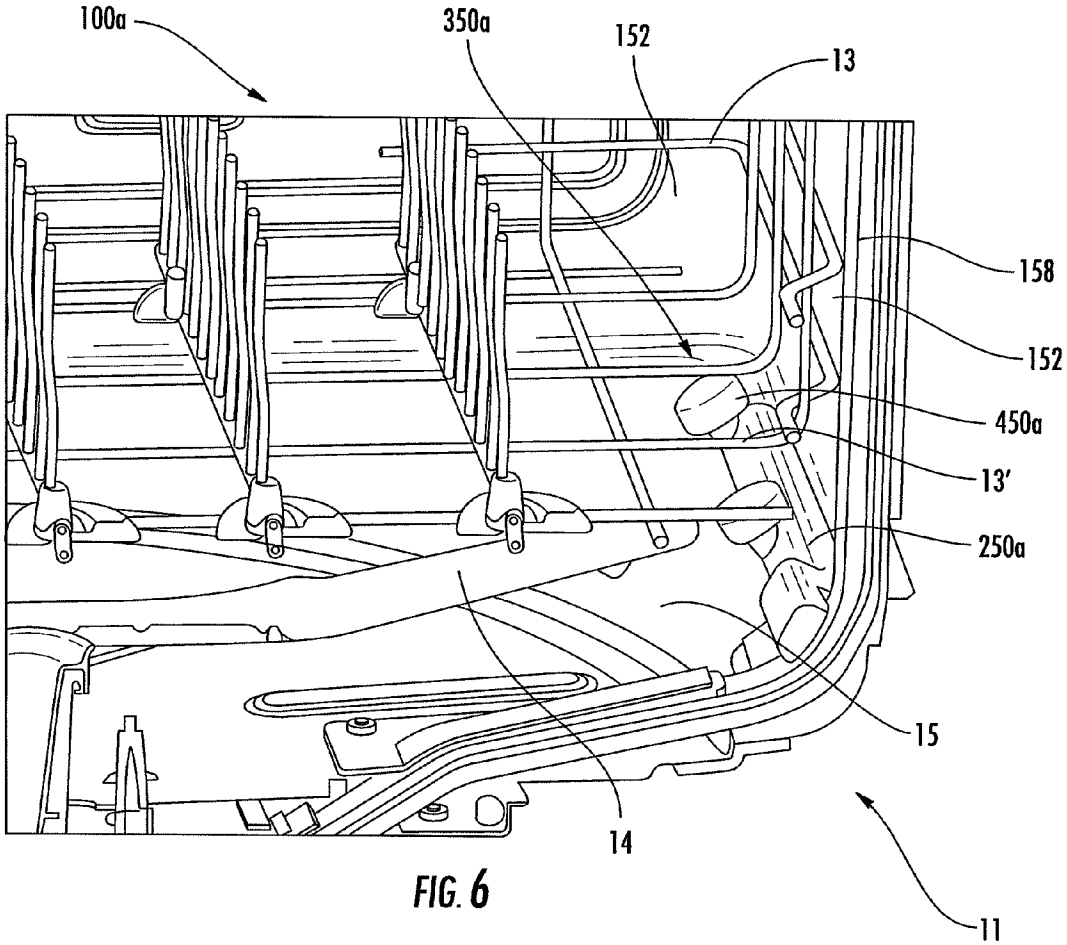

The at least one nozzle member 400*a* may be directly engaged with and supported by the dishwashing fluid supply conduit 250*a*, or may have a support member 450*a* (otherwise referred to herein as a "nozzle head 450*a*") disposed therebetween. As illustrated in FIG. 2, for example, in some embodiments the dishwashing fluid supply conduit 250*a* may define a manifold to which one or more nozzle heads 450*a* are coupled. The nozzle head 450*a*, where implemented, may be configured to be fixed with respect to the dishwashing fluid supply conduit 250*a*. In some instances, however, the nozzle head 450*a* may be movable with respect to the dishwashing fluid supply conduit 250. For example, the nozzle head 450*a*, in some instances, may be rotatable with respect to the dishwashing fluid supply conduit 250*a*. Further, whether operably engaged directly with the dishwashing fluid supply conduit 250*a*, or with the nozzle head 450*a*, the nozzle member 400*a* may be further configured to form one of a fixed fluid jet, a moving fluid jet, a pulsating fluid jet, a vortex fluid jet, a rotating fluid jet, an oscillating fluid jet, a random fluid jet, combinations thereof, and other embodiments of fluid jets and emissions. In doing so, one skilled in the art will appreciate that the nozzle member 400*a* may be fixed or movable with respect to the dishwashing fluid supply conduit 250*a* or the nozzle head 450*a*, as necessary or desirable, to form the corresponding fluid jet.

In one aspect of the present invention, the nozzle member 400*a* is configured to direct dishwashing fluid jet(s) toward a designated area or disposition of the rack 13 for concentrated and/or intensified cleaning of particular dishware placed in that location within the rack 13. To assist the user in making use of the disclosed fluid circulation arrangement 100*a*, the designated area of the rack 13 may be indicated or otherwise denoted in different manners such as, for example, by unique coloration, distinctive tines or tine arrangements, and/or any other suitable indicia. One skilled in the art will appreciate, however, that such indication of the designated area of the rack 13 may vary considerably, and the examples presented herein are for illustrative purposes only and are not intended to be limiting in this respect. In some instances, the designated area of the rack 13 may be particularly configured such that the dishware is placed therein in a vertical or near vertical orientation for minimizing the footprint thereof in the rack 13. However, in other instances, the dishware may be placed in a horizontal or near horizontal orientation, as necessary or desirable.

In light of the designated area of the rack 13, the nozzle member(s) 400*a* may further be operably engaged with the dishwashing fluid supply conduit 250*a* or the nozzle head 450*a* so as to provide an optimal or otherwise effective dishwashing fluid emission pattern focusing on the designated area. In doing so, particularly in instances where multiple nozzle members 400*a* are implemented, the nozzle members 400*a* may be appropriately spaced apart and/or oriented to provide the desired fluid emission pattern, wherein the particularly configured nozzle members 400*a*, or combinations thereof, cooperate to provide the intensified and/or concentrated wash effect for breaking down and removing heavy or baked-on food soils from the dishware in the designated area. For example, in one instance, the nozzle member(s) 400*a* may be mounted to the dishwashing fluid supply conduit 250*a* and disposed at an angle of between about 30 degrees and about 45 degrees with respect to the designated area so as to provide the desired fluid flow and fluid emission pattern to the designated area.

Figure 7:
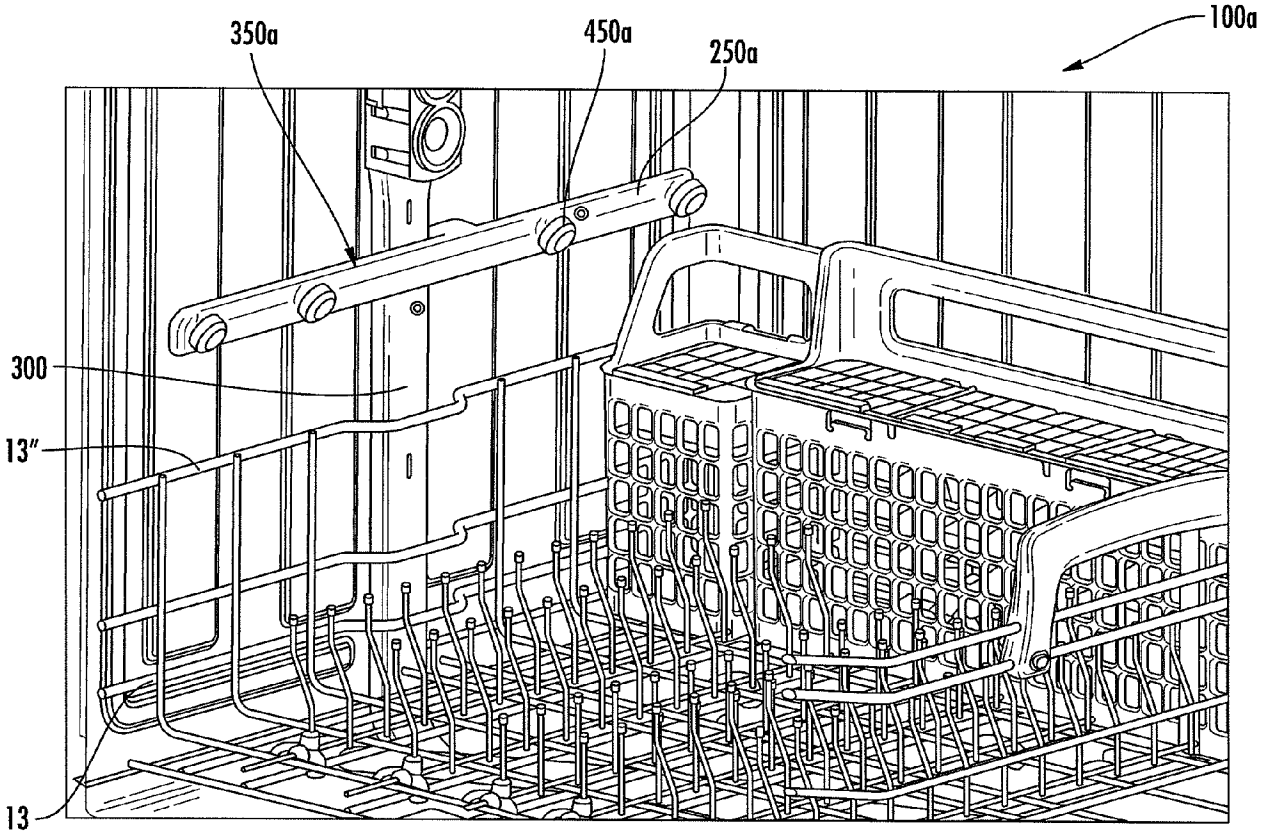
Figure 8:
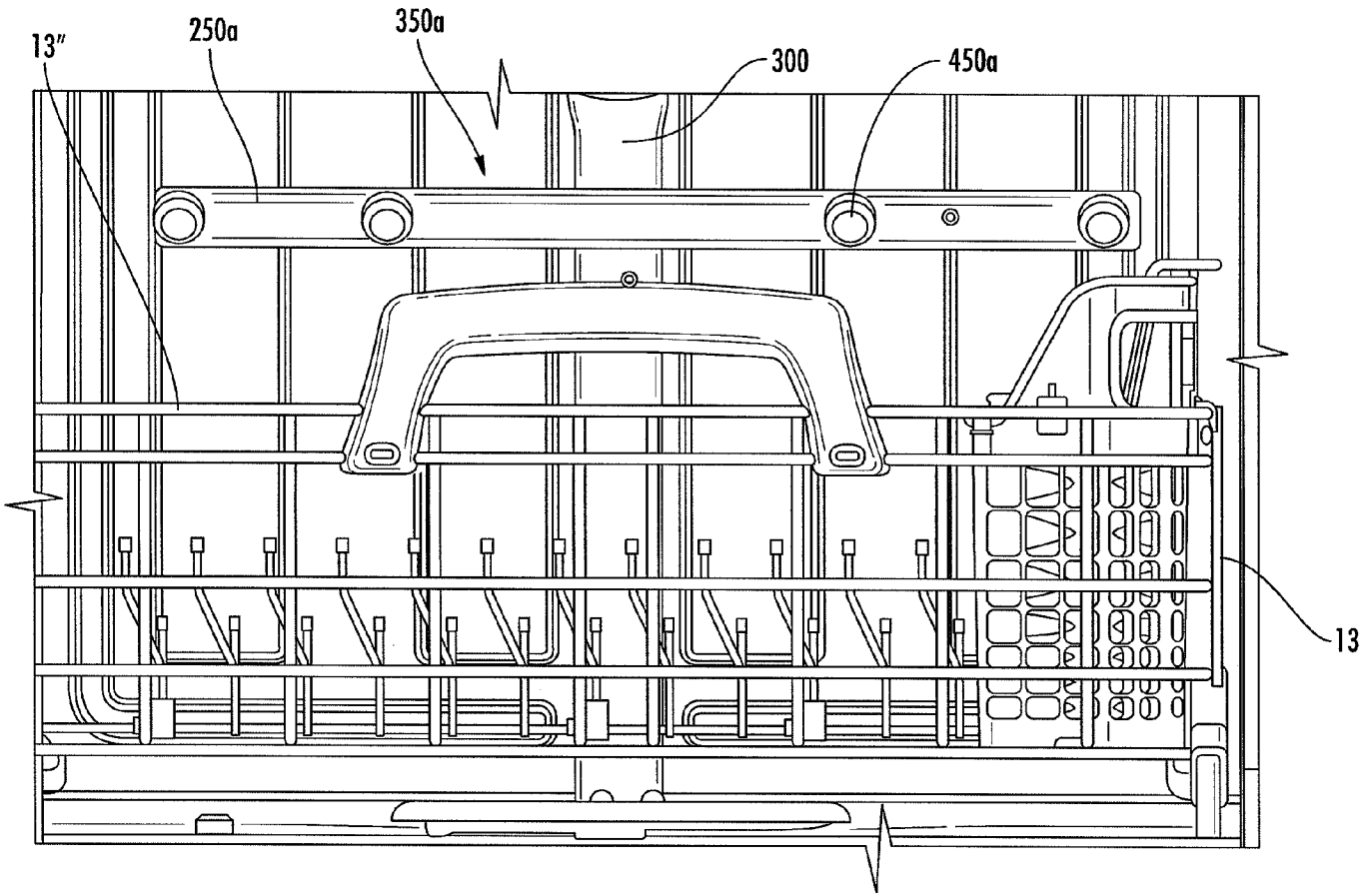
Figure 9:
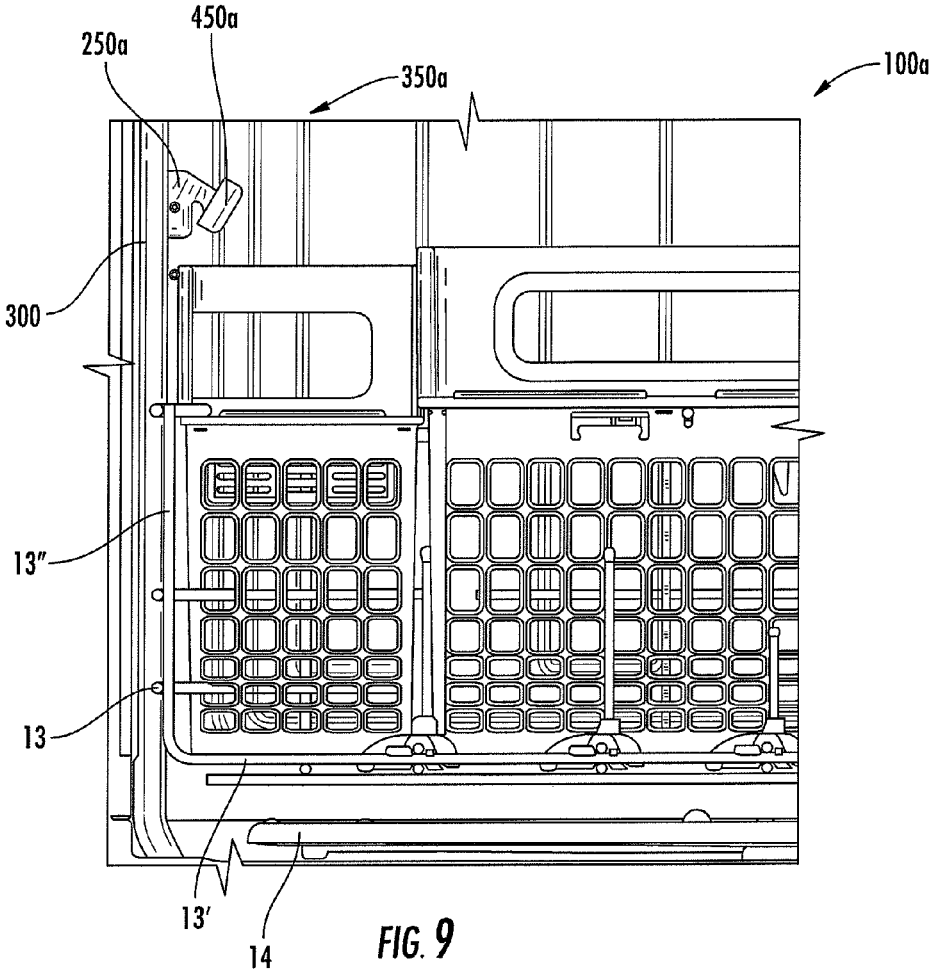

FIGS. 7-9 illustrate a variation of the embodiment of the fluid circulation arrangement 100*a* illustrated in FIGS. 2-6. In the variation illustrated in FIGS. 7-9, the spray assembly 450*a* is positioned above the rack 13 and may direct the fluid downwardly towards the dishware in the rack 13. In this regard, the spray assembly 350*a* may mount to the main fluid supply channel 300 above the rack 13 at any desired position therealong. The nozzle heads 450*a* may in some embodiments additionally or alternatively be directed toward the upper rack 12. For example, the angle of the nozzle heads 450*a* may be adjustable in some embodiments. Furthermore, the spray assembly 450*a* may be coupled to the sidewall of the rack 13 in one embodiment such that the nozzle heads 450*a* are configured to direct water above the upper edge of the sidewall and into the interior of the rack.

Figure 7A:
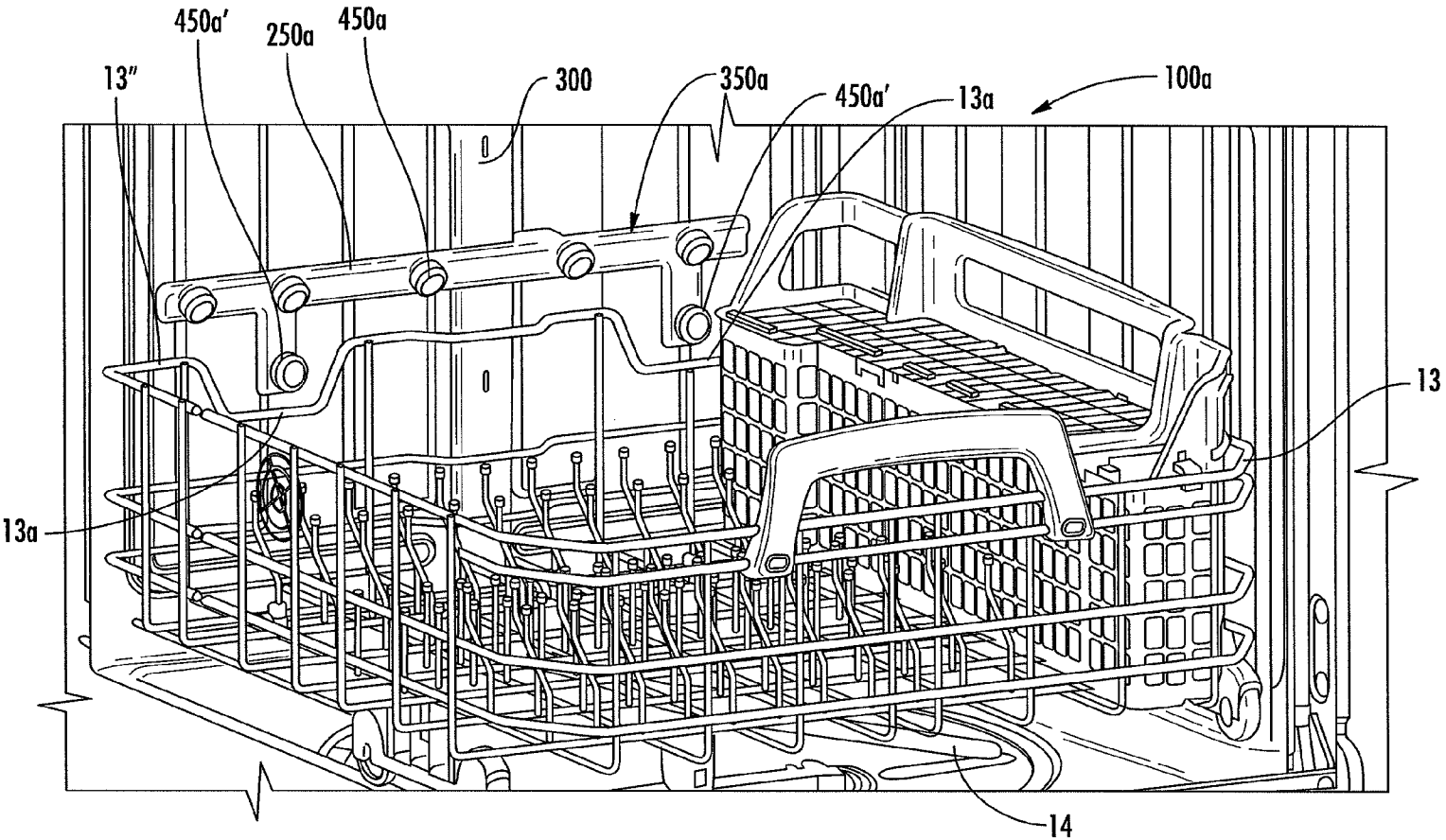
Figure 8A:
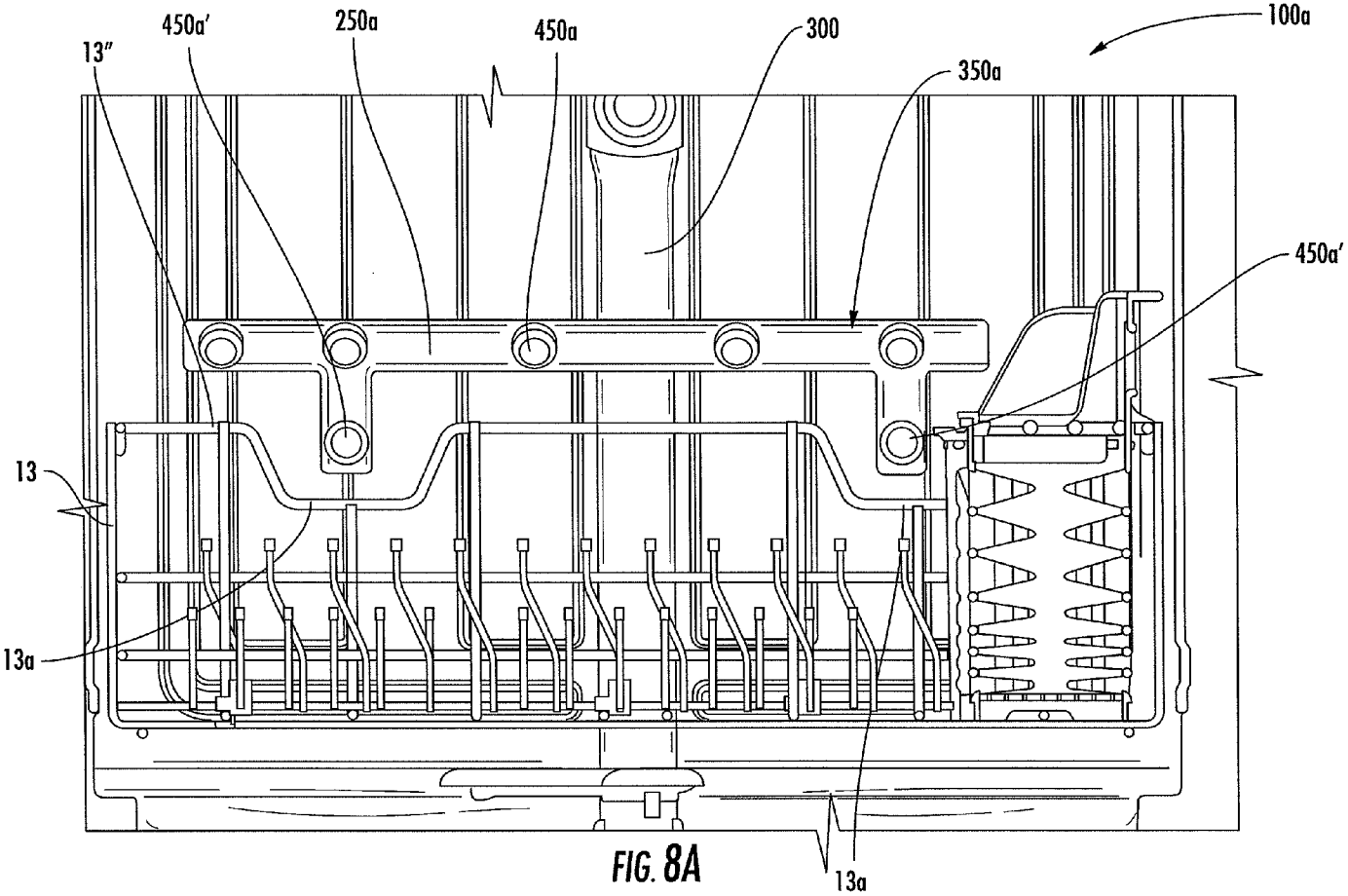
Figure 9A:
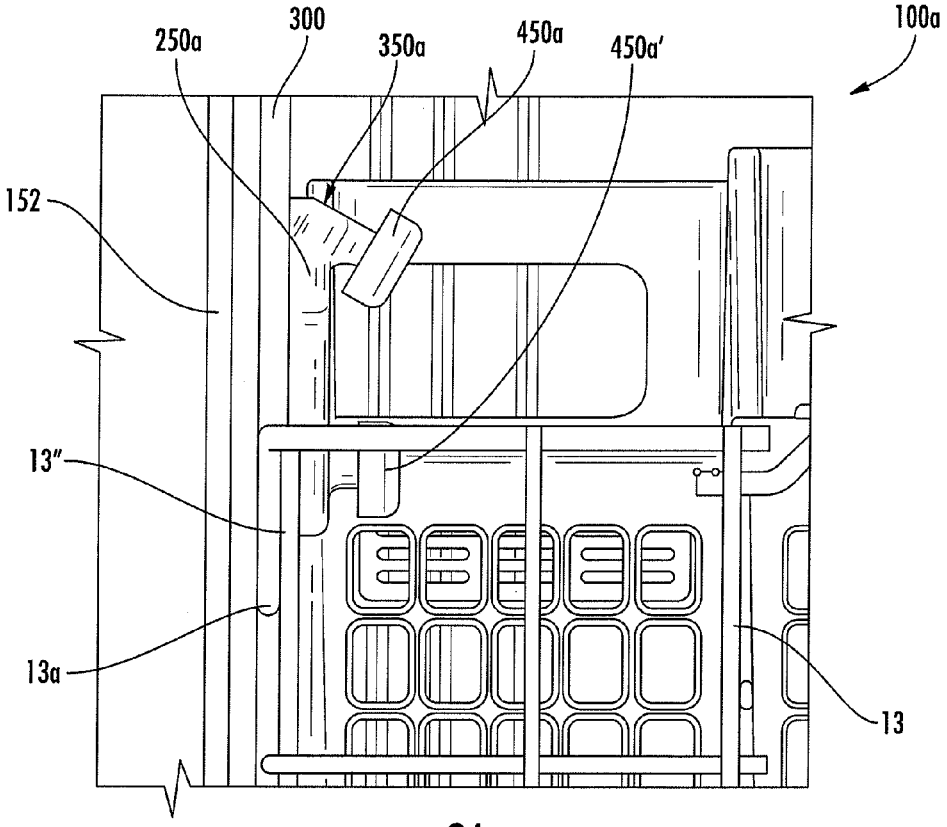
Figure 10:
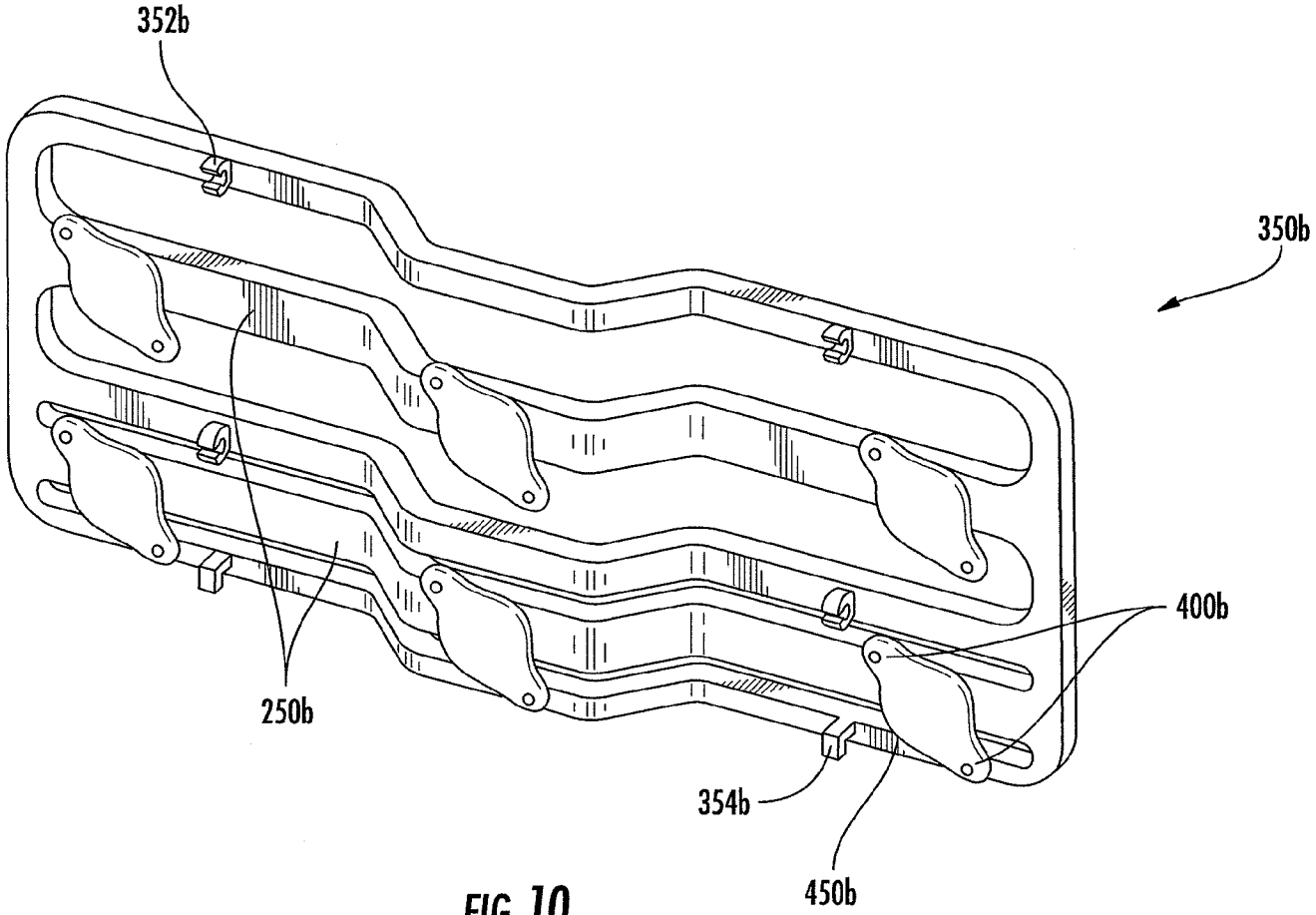
FIGS. 10-18 illustrate various views of a fluid circulation arrangement according to a second embodiment of the present invention, wherein a spray assembly is supported by a sidewall of a rack.
Figure 11:
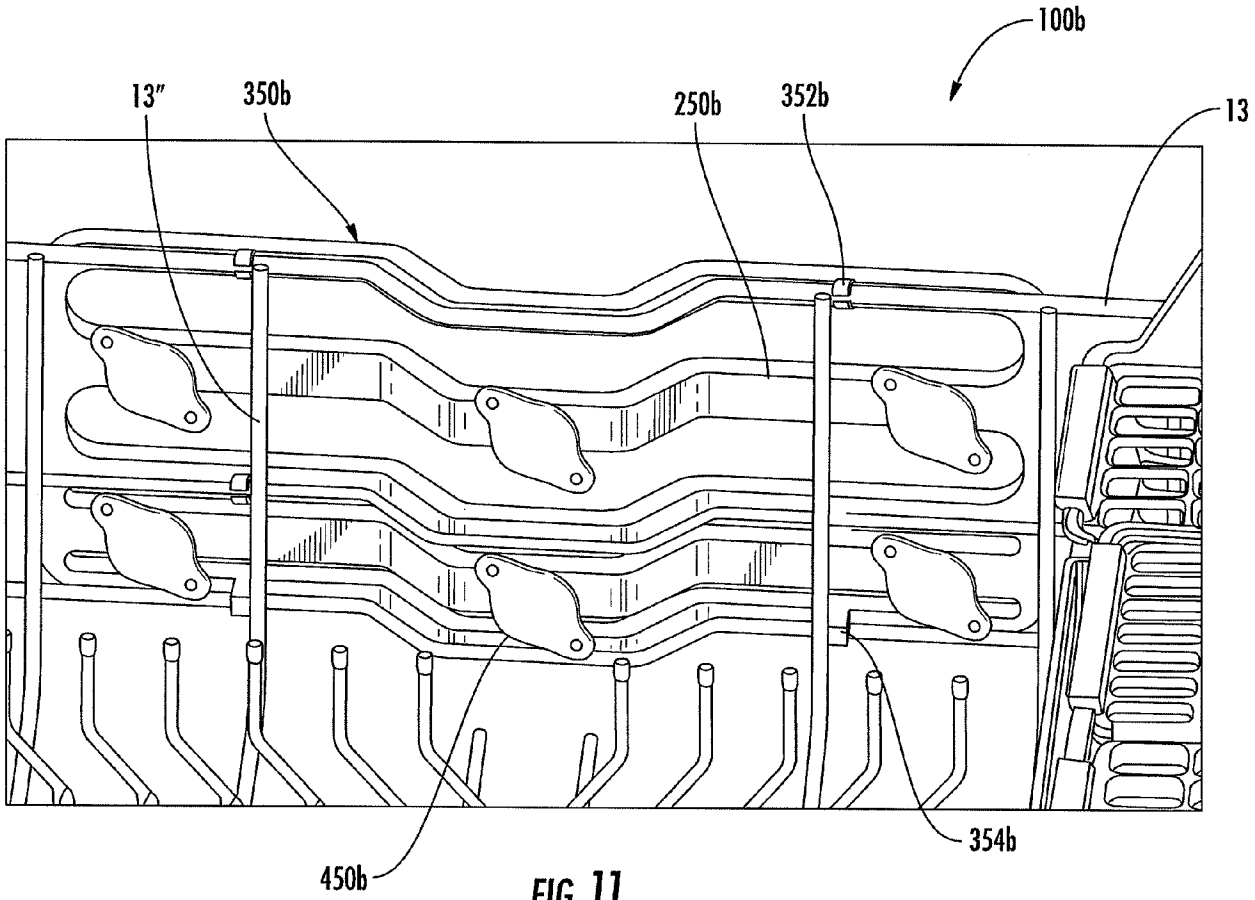
Figure 12:
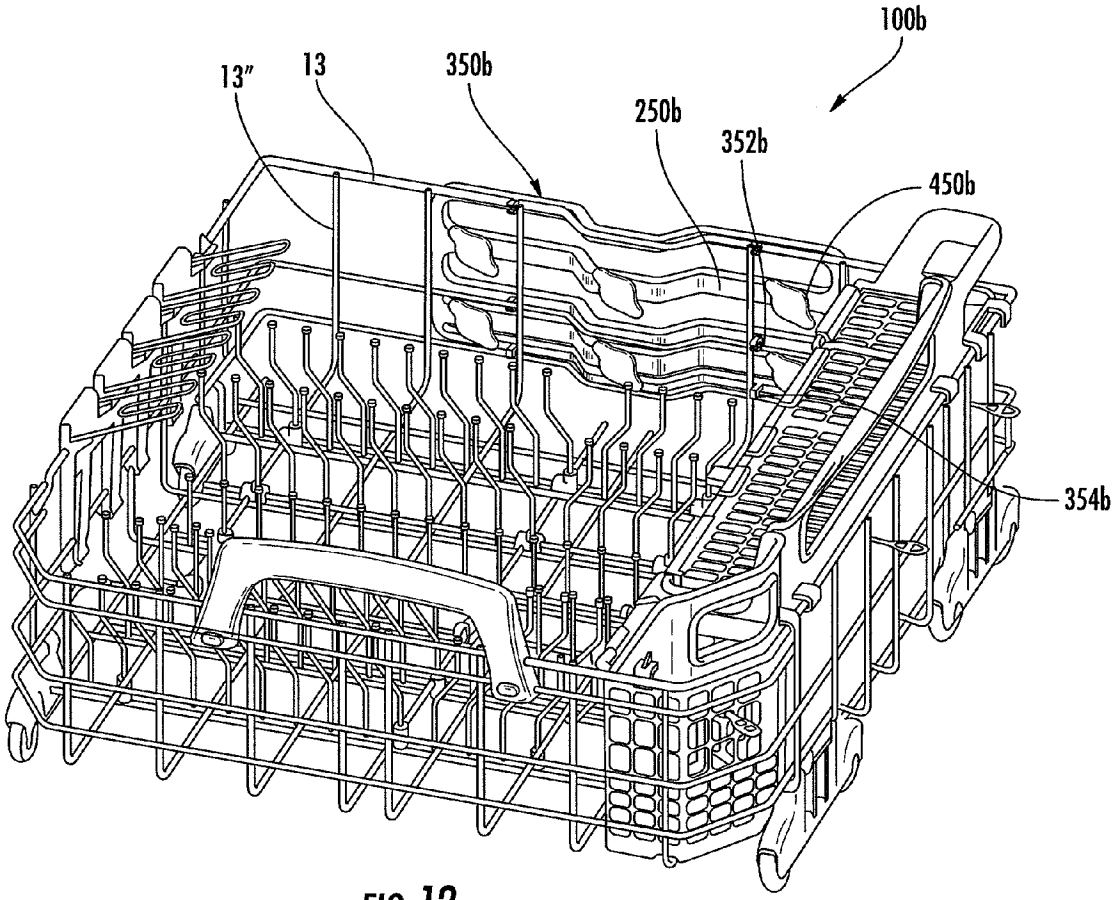
Figure 13:
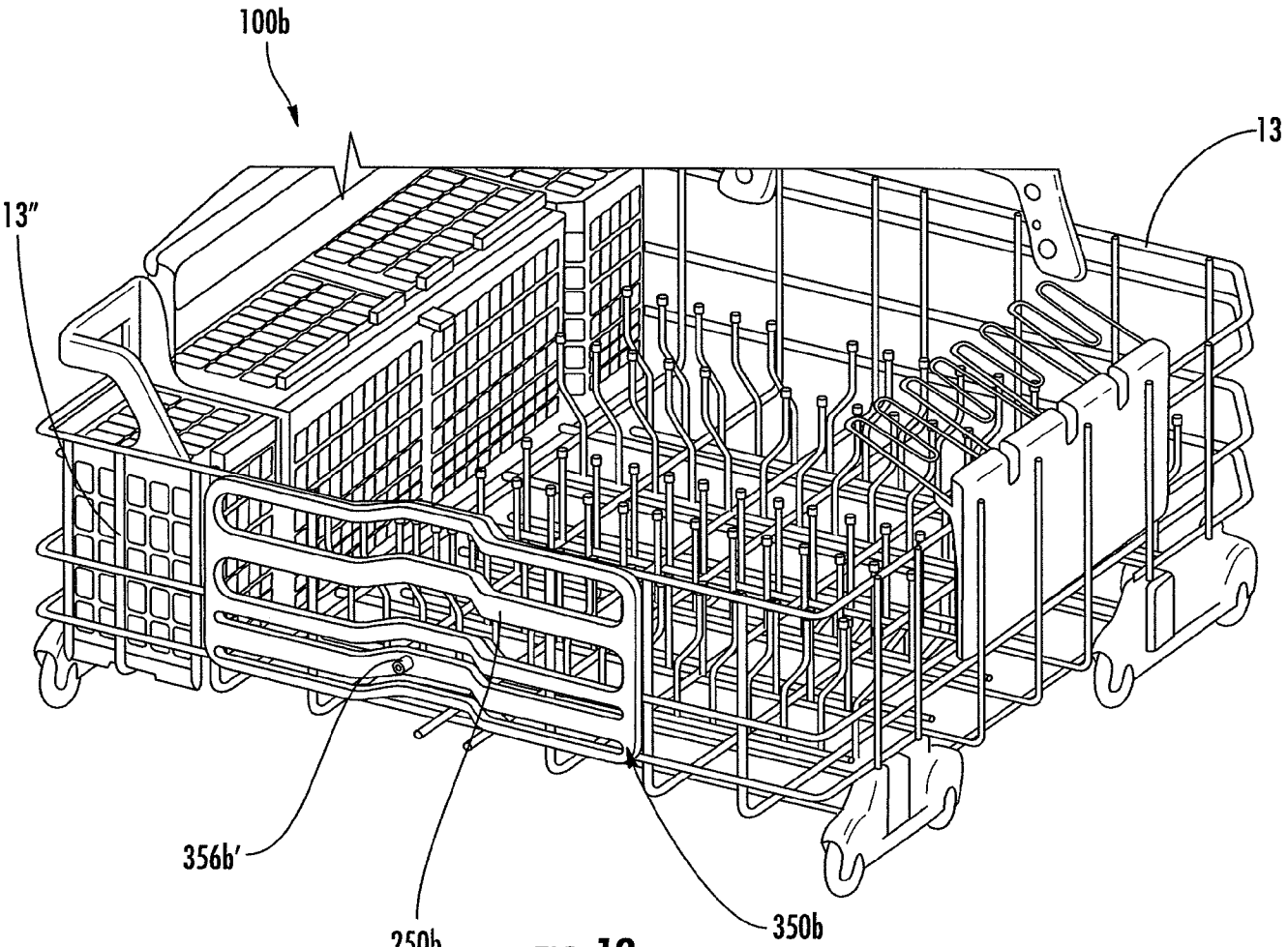
Figure 14:
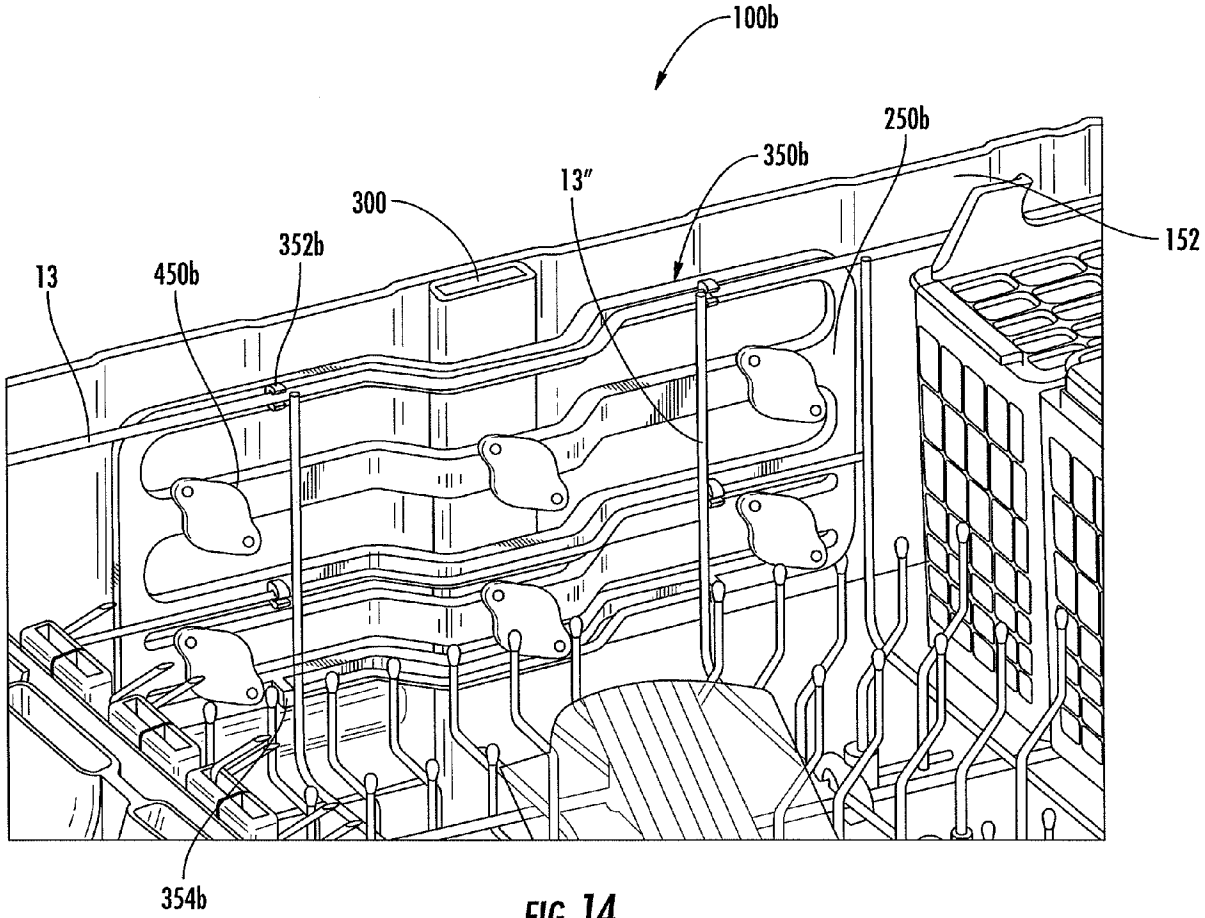
Figure 15:
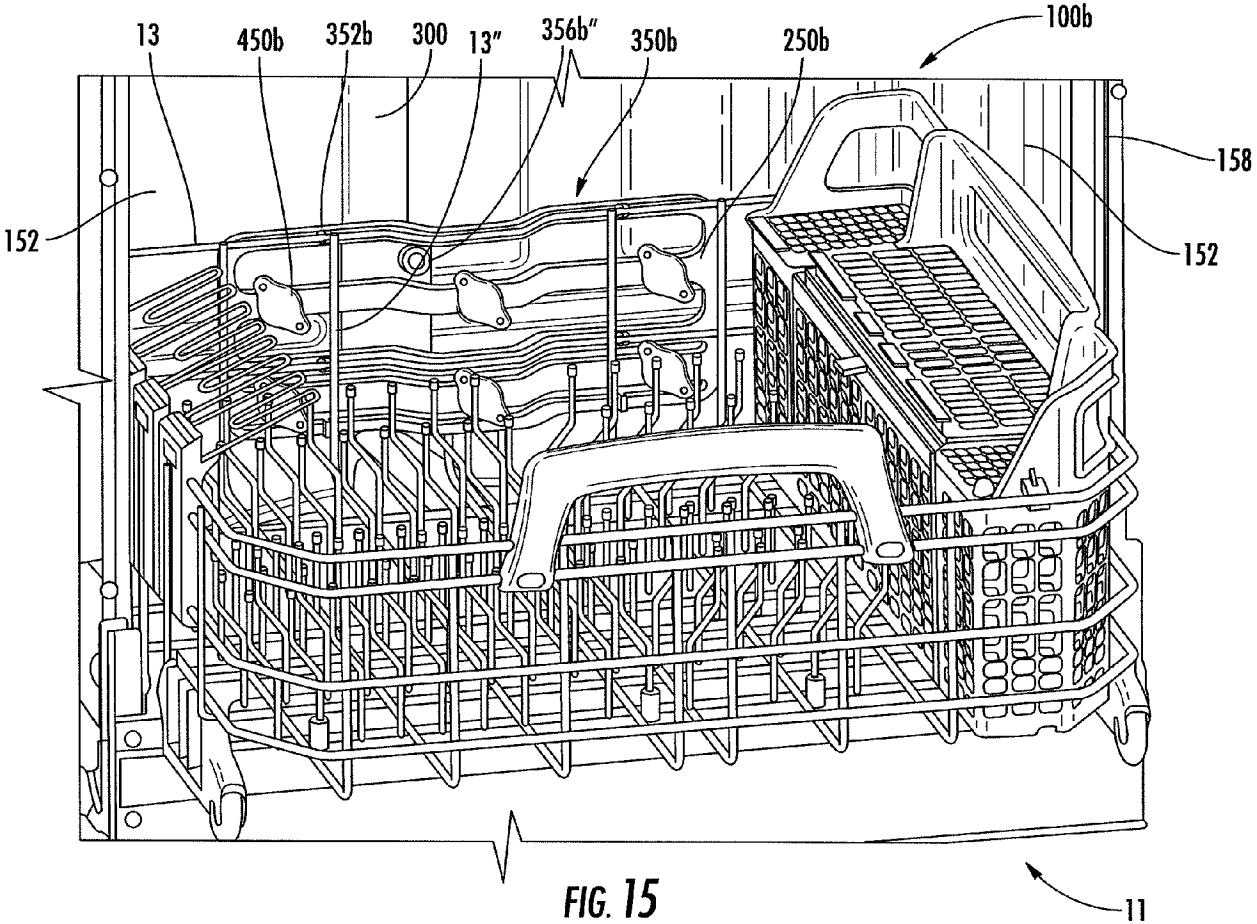
Figure 16:
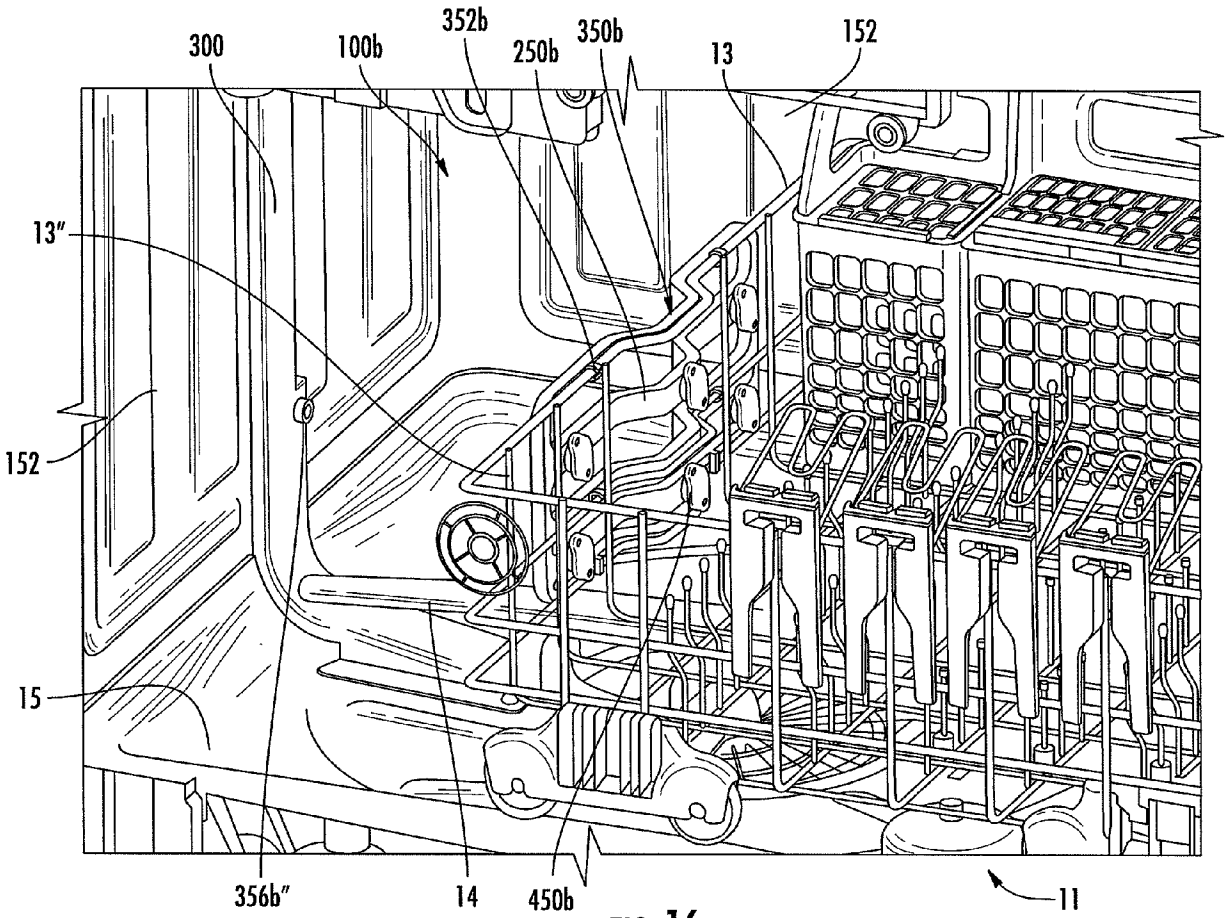

FIGS. 7A, 8A, and 9A illustrate a further variation of the fluid circulation arrangement 100*a*. The variation illustrated in FIG. 7A, FIG. 8A, and FIG. 9A is similar to the embodiment illustrated in FIGS. 7-9, except the sidewall 13" of the rack 13 includes two portions with lower sidewalls 13*a* above which are positioned additional nozzle heads 450*a*'. Thereby, the spray assembly 350*a* may direct dishwashing fluid above the lower sidewalls 13*a* with the additional nozzle heads 450*a*' to clean dishware within the rack 13 at other positions. As illustrated in FIG. 9A, in some embodiments the nozzle heads 450*a* (including the additional nozzle heads 450*a*') may extend away from the sidewall 152 above the rack 13. However, in other embodiments the nozzle heads 450*a* may not necessarily extend away from the sidewall over the rack 13. For example, the nozzle heads 450*a* may in other embodiments be recessed from the rack 13 in the horizontal direction. In such embodiments the lower sidewalls 13*a* may assist the additional nozzle heads 450*a*' in spraying over the top edge of the sidewall. Spraying over the top edge of the sidewall may avoid issues with the rack 13 blocking the spray of dishwashing fluid, though in other embodiments the nozzle heads 450*a* may spray the dishwashing fluid through the rack 13. It is understood that various rack configurations may be employed, such as an undulating top edge of the sidewall, such that each nozzle corresponds to an associated lower sidewall 13*a*. Moreover, as discussed above, although the spray assembly 350*a* is show as being coupled to the tub, the spray assembly may be coupled to the sidewall of the rack 13 so as to be carried by the rack or otherwise supported thereby.

In further non-limiting examples, particularly configured nozzle heads 450*a* may be combined with particularly configured nozzle members 400*a*, as follows: (1) Fixed nozzle head with nozzle member(s) providing oscillating fluid jet(s); (2) Fixed nozzle head with nozzle member(s) providing vortex fluid jet(s); (3) Fixed nozzle head with nozzle member(s) providing rotating fluid jet(s); (4) Rotating nozzle head with nozzle member(s) providing fixed and rotating fluid jets; (5) Rotating nozzle head with nozzle member(s) providing vortex and rotational fluid jets; and (6) Rotating nozzle head with nozzle member(s) providing oscillating and rotating fluid jets.

Thus, as described above with respect to the embodiment of the fluid circulation arrangement 100*a* illustrated in FIGS. 2-9, in some embodiments the spray assembly may be coupled to a dishwashing fluid supply channel, such as the main dishwashing supply channel, for example through the dishwashing fluid supply conduit so as to be supported thereby. However, the spray assembly may be supported in various other manners and other locations on the rack in other embodiments.

For example, FIGS. 10-18 illustrate an alternate embodiment of a fluid circulation arrangement 100*b*. In this embodiment the spray assembly 350*b* is coupled to the rack 13 so as to be supported thereby, wherein the spray assembly includes a manifold and a plurality of nozzle members coupled thereto. In particular, in the illustrated embodiment the spray assembly 350*b* is coupled to a sidewall 13" of the rack 13. By coupling the spray assembly 350*b* to the sidewall 13" of the rack 13, the fluid circulation arrangement 100*b* may advantageously direct the dishwashing fluid at the dishware from close proximity, among other advantages. The fluid circulation arrangement 100*b* may comprise at least one attachment member configured to couple the spray assembly 350*b* to the sidewall 13" of the rack 13. For example, the attachment member may comprise a plurality of clips 352*b* and tabs 354*b* in the illustrated embodiment of the fluid circulation arrangement 100*b* which grasp the sidewall 13" of the rack 13 (e.g., the horizontal and/or vertical wires of the rack). As illustrated, in some embodiments the attachment assemblies may engage the sidewall 13" of the rack 13 so as to position the spray assembly 350*b* adjacent to the rack. In one embodiment, the spray device 350*b* is positioned outside of the interior of the rack 13. In such embodiments, the nozzle heads 450*b* may extend at least partially through the sidewall 13" and into the interior of the rack 13. The nozzle heads 450*b* may be coplanar with the sidewall 13" of the rack 13, or extend such that the nozzle heads 450*b* do not extend to or through the sidewall 13" of the rack 13.

Figure 17:
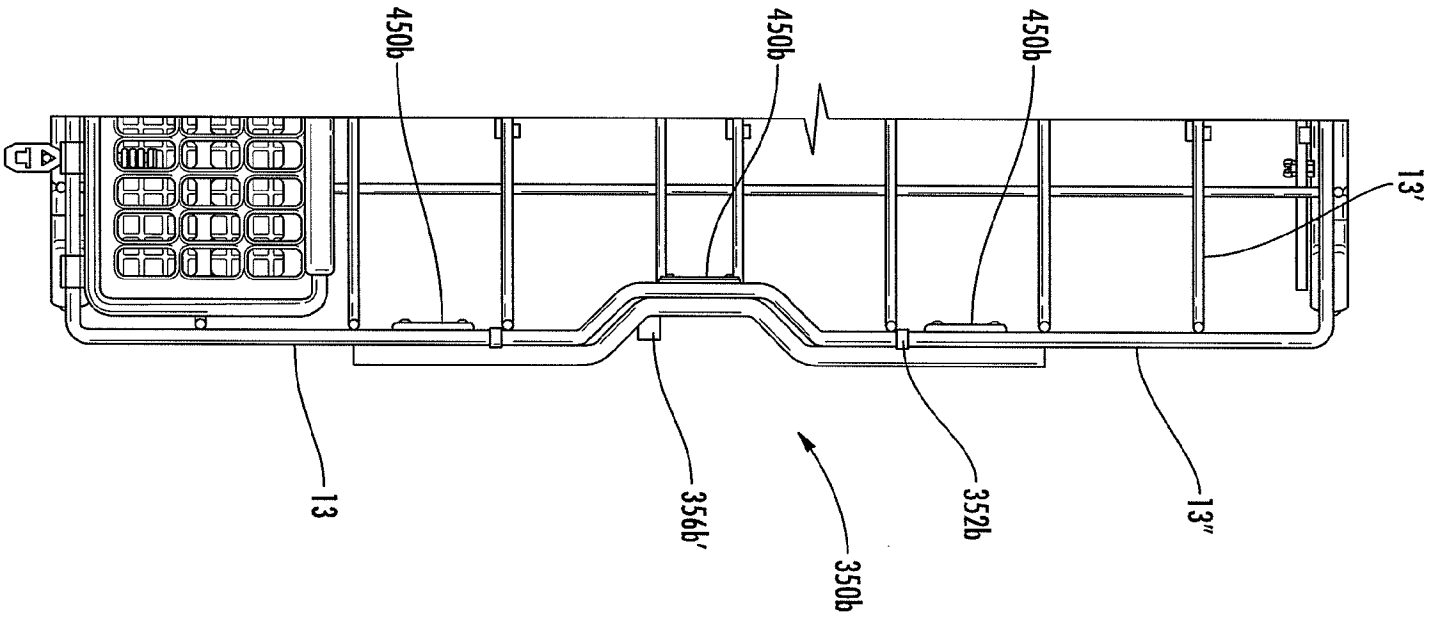
Figure 18:
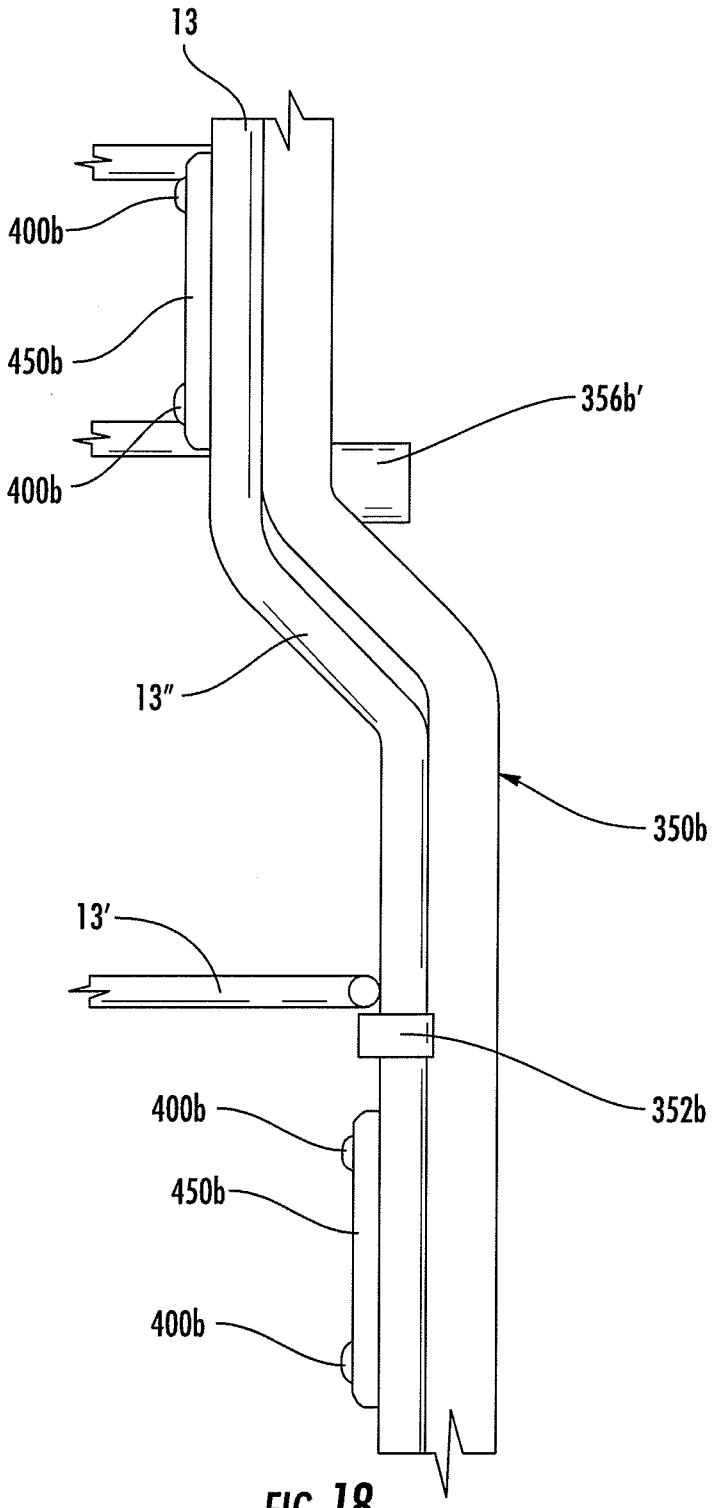
Figure 19:
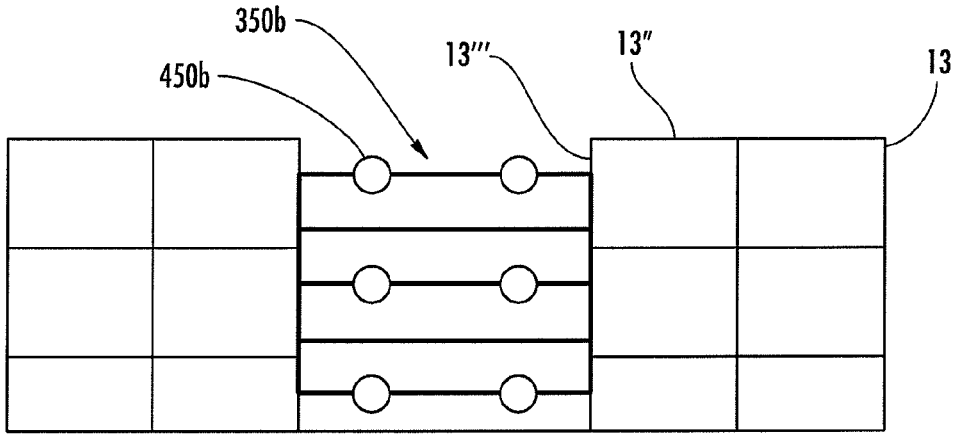
FIG. 19 illustrates a view of the sidewall of a rack according to one embodiment of the present invention wherein the rack defines a cutout portion.
Figure 20:
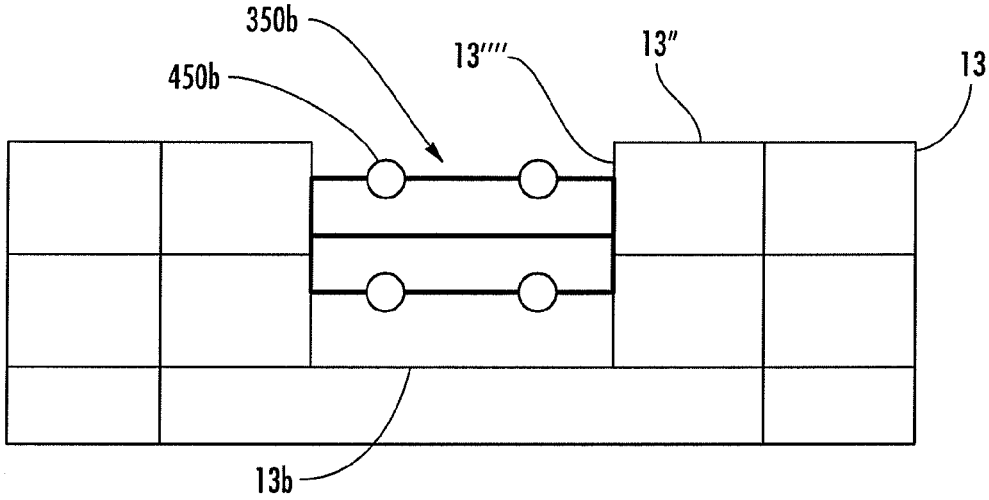
FIG. 20 illustrates a view of the sidewall of a rack according to one embodiment of the present invention wherein the rack defines a removed section.

FIGS. 17-18 illustrate an embodiment in which the nozzle heads 450*b* extend partially through the sidewall 13" and into the rack 13 such that the dishwashing fluid need not travel through the rack 13 to reach the dishware. In other embodiments the attachment assemblies may couple the spray assembly 350*b* to the inside of the rack 13 with various nozzle head 450*b* configurations as described above. Further, in some embodiments the sidewall 13" may comprise a removed or lower portion whereby the spray assembly 350*b* is coupled to the sidewall 13" such that the nozzle members 400*b* do not direct the dishwashing fluid through the sidewall 13" of the rack 13, but rather direct the fluid between the portions which are removed or above the lower portion. For example, FIG. 19 illustrates an embodiment of the rack 13 comprising a removed portion 13'" from the sidewall 13" wherein the spray assembly 350*b*, which may comprise a plurality of spray heads 450*b*, is inserted therein. By way of further example, FIG. 20 illustrates an embodiment of the rack 13 comprising a cutout portion 13"". In this embodiment the spray assembly 350*b* may be coupled to the sidewall 13" of the rack 13 such that the spray assembly 350*b* is positioned in the cutout portion 13"" above a lower sidewall 13*b*. However, various other configurations may be employed as may be understood by one having skill in the art. For example, the sidewall of the upper edge of the sidewall 13" may include an undulated surface, as described above, wherein each spray head 450*b* is positioned within an undulation and configured to direct water into the interior of the rack.

In some embodiments the spray assembly 350*b* comprises one or more dishwashing fluid supply conduits 250*b*, as illustrated, thereby defining a manifold. As shown in FIG. 17, for example, the fluid supply conduits 250*b* may be contoured to conform to the shape of the sidewall 13". The spray assembly 350*b* may be configured to receive the dishwashing fluid through the dishwashing fluid supply conduit 250*b* from a dishwashing fluid supply channel, such as the main dishwashing fluid supply channel 300, and to dispense the dishwashing fluid therefrom through at least one nozzle member 400*b* associated therewith, so as to provide at least one of a concentrated wash effect and an intensified wash effect at a selected disposition within rack 13. As described above, various nozzle members 400*b* may be employed in order to direct water towards the dishware. For example, the nozzles members 400*b* may be fixed, rotating, or pivotable so as to be able to direct water at a fixed or variable angles.

In order for the dishwashing fluid supply conduit 250*b* to receive the dishwashing fluid from a dishwashing fluid supply channel, the fluid circulation arrangement 100*b* may comprise a fluid connector which provides for fluid communication. In the embodiment illustrated in FIGS. 10-20, the fluid connector comprises a releasable fluid connector 356*b* comprising a first connector 356*b*' extending from, or otherwise coupled to, the spray assembly 350*b* (see, e.g. FIG. 13) and a second connector 356*b*" extending from, or otherwise coupled to, the main dishwashing fluid supply channel 300 (see, e.g. FIGS. 15 and 16). In such embodiments the rack 13 may be moveable between a loading position (see, e.g. FIG. 16) wherein the rack 13 extends from the tub portion 11 and an operating position (see, e.g. FIG. 14) wherein the rack is fully inserted into the tub portion 11 such that the first connector 356*b*' and the second connector 356*b*" engage one another such that the spray assembly 350*b* is coupled to the main fluid supply channel 300. However, various other configurations for providing dishwashing fluid to the spray assembly 350*b* may be possible as understood by one having skill in the art.

Since, as previously disclosed, the designated area of the rack 13 may, in some instances, be configured to receive the dishware in both substantially vertical and substantially horizontal orientations (i.e., the soiled surface is oriented substantially vertically or horizontally), there may be instances in which the disclosed fluid circulation arrangement 100 may not be optimized for a particular orientation of the dishware. Accordingly, in some aspects, the fluid circulation arrangement may further comprise an arm 500*c-h* to which the nozzle member is attached, as shown in FIGS. 21-30. In some instances, the arm 500*c-h* may be configured to receive the dishwashing fluid and to channel the dishwashing fluid therethrough to the nozzle member, and thus the dishwashing fluid supply conduit may extend through the arm 500*c-h* in some embodiments. However, in other instances, the arm may be supported by a particular conduit or manifold, and in fluid communication therewith, for supplying the dishwashing fluid to the nozzle assembly.

In light of the varying orientation of the dishware, the arm may be fixed with respect to the rack 13 or dishwashing fluid supply channel (e.g. main dishwashing fluid supply channel 300), for supporting a nozzle head and one or more nozzle members, for example, at a selected distance therefrom, at a selected orientation with respect to the designated area, and/or at a selected distance from the designated area. In one embodiment, the arm is coupled to the sidewall and/or bottom of the rack 13 such that the arm is carried by the rack. Moreover, the arm may be configured to extend substantially parallel to one of the side walls 152 of the tub portion 11 (i.e., to raise or lower the spray assembly with respect to the designated area) or substantially parallel to the bottom wall 15 of the tub portion 11 (i.e., to support the spray assembly inwardly with respect to the bottom wall, possibly closer to the designated area). Such varying configurations of the arm may further allow the fluid jets to be directed vertically (to address horizontally oriented dishware) or horizontally (to address horizontally oriented dishware). In instances where differently configured arms are provided, the spray assemblies associated with such arms may be user-selectable or automatically-selectable based on a discerned orientation of the dishware (i.e., only vertically directed fluid jets are selected when the dishware is horizontally oriented in the designated area).

In other aspects, the arm 500*c-h* may be configured to be movable with respect to the rack 13 or dishwashing fluid supply channel so as to, for example, reduce the number of fixed arms, or to promote storage of the arms and associated nozzle members when such are not being used in a particular wash cycle. For example, the arm may be pivotable with respect to the rack 13 or dishwashing fluid supply channel so as to be movable between a first position extending substantially parallel to one of the side walls 152 of the tub portion 11 (e.g. vertically) and a second position extending substantially parallel to the bottom wall 15 of the tub portion 11 (e.g. horizontally). In some instances, the spray assembly may also be capable of re-orientation upon movement (pivoting) of the arm. For example, a nozzle head 450/nozzle member 400 may extend from opposing surfaces of the arm 500, wherein the appropriate nozzle head/nozzle member may be selected, whether by a diverter valve or otherwise, depending on the disposition of the arm. In another example, the nozzle head/ nozzle member 400 may be mounted in a "ball and socket" arrangement with respect to the arm, such that the nozzle head and/or nozzle member may be rotated toward the desired direction appropriate for the disposition of the arm. For further versatility, the arm 500 in some instances may be configured to be, for example, rotatable about an axis defined thereby, extendable along the axis, and or articulating, as necessary or desirable.

One or more such arms may be implemented in conjunction with a plurality of spray assemblies, as preciously disclosed. In such instances, the versatility promoted by the arms may allow the fluid jets to be more optimally directed toward the designated area of the rack 13, in response to the user placing the soiled dishware in either of a substantially horizontal or substantially vertical orientation based upon, for example, user preference or the size of the dishware item.

Further non-limiting examples of particularly configured nozzle members which may be combined with particularly configured arms, in some instances with particularly configured nozzle heads, are as follows: (1) Fixed vertically-oriented arm with nozzle member(s) providing oscillating fluid jet(s); (2) Fixed horizontally-oriented arm with nozzle member(s) providing oscillating fluid jet(s); (3) Movable arm with nozzle member(s) providing oscillating fluid jet(s); (4) Fixed vertically-oriented arm with nozzle member(s) providing vortex fluid jet(s); (5) Fixed horizontally-oriented arm with nozzle member(s) providing vortex fluid jet(s); (6) Movable arm with nozzle member(s) providing vortex fluid jet(s); (7) Fixed vertically-oriented arm with nozzle member(s) providing rotating fluid jet(s); (8) Fixed horizontally-oriented arm with nozzle member(s) providing rotating fluid jet(s); (9) Movable arm with nozzle member(s) providing rotating fluid jet(s); (10) Fixed vertically-oriented arm with rotating nozzle head and nozzle member(s) providing oscillating fluid jet(s); (11); Fixed horizontally-oriented arm with rotating nozzle head and nozzle member(s) providing oscillating fluid jet(s); (12) Movable arm with rotating nozzle head and nozzle member(s) providing oscillating fluid jet(s); (13); Fixed vertically-oriented arm with rotating nozzle head and nozzle member(s) providing rotating fluid jet(s); (14) Fixed horizontally-oriented arm with rotating nozzle head and nozzle member(s) providing rotating fluid jet(s); (15) Movable arm with rotating nozzle head and nozzle member(s) providing rotating fluid jet(s); (16) Fixed vertically-oriented arm with rotating nozzle head and nozzle member(s) providing vortex fluid jet(s); (17) Fixed horizontally-oriented arm with rotating nozzle head and nozzle member(s) providing vortex fluid jet(s); (18) Movable arm with rotating nozzle head and nozzle member(s) providing vortex fluid jet(s); and (19) Movable arm with rotating nozzle head and nozzle members providing vortex and rotating fluid jets.

Figure 21:
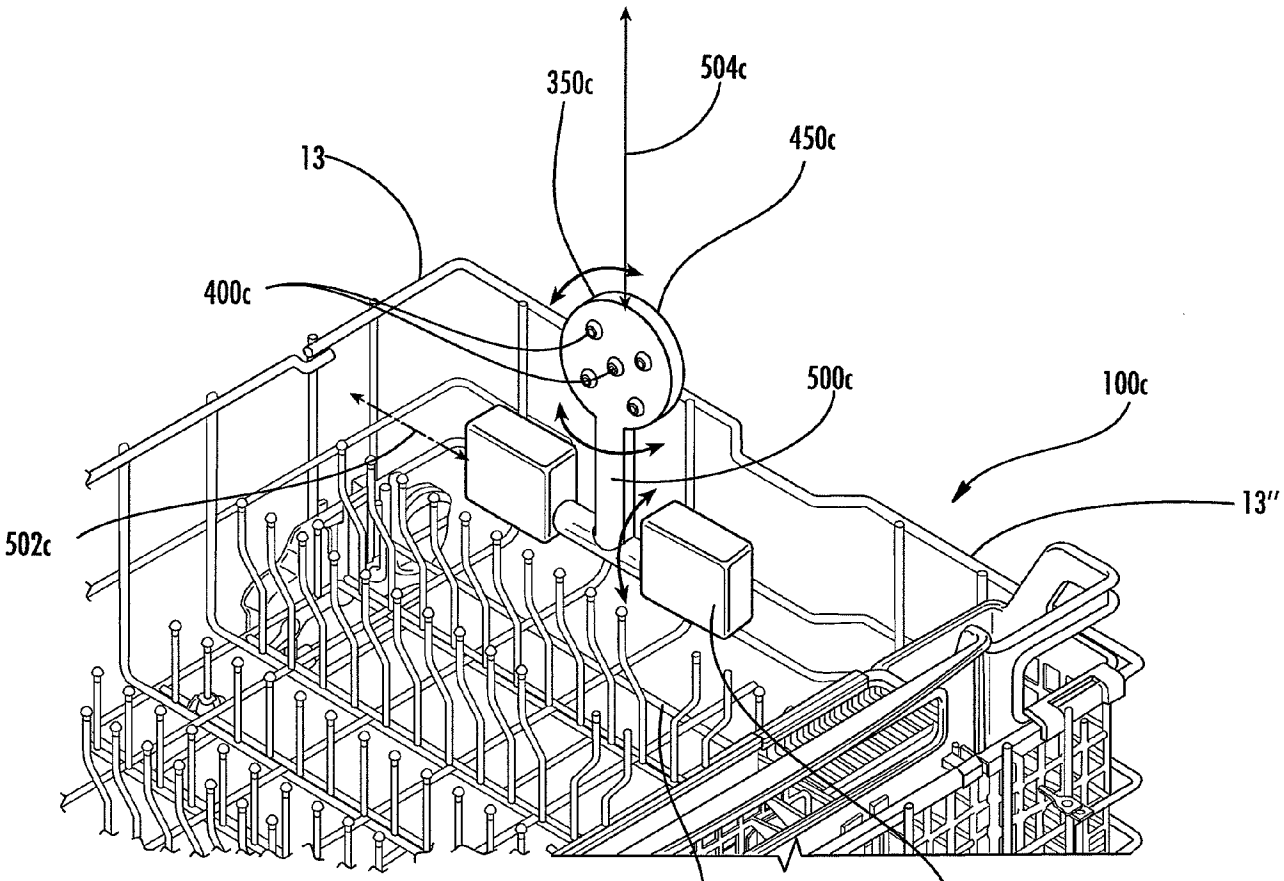
FIGS. 21-23 illustrate various views of a fluid circulation arrangement according to a third embodiment of the present invention, wherein the spray assembly comprises an arm which is rotatable about an axis and a second axis.
Figure 22:
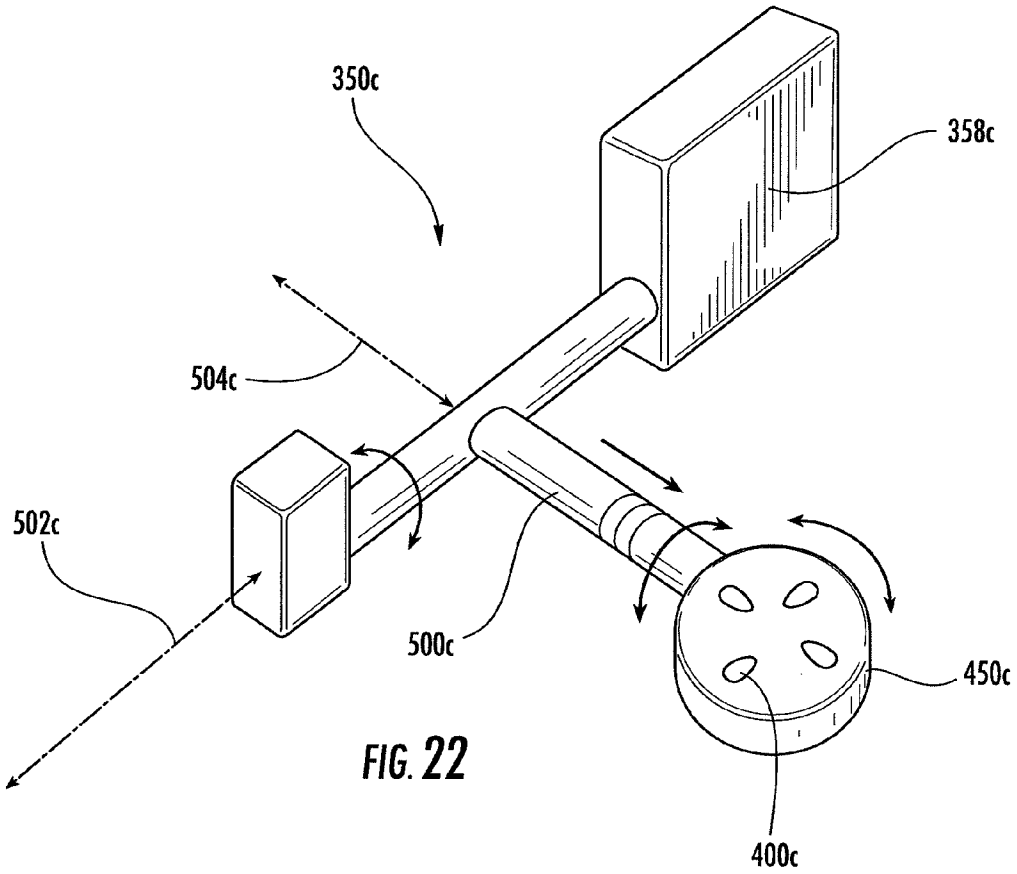
Figure 23:
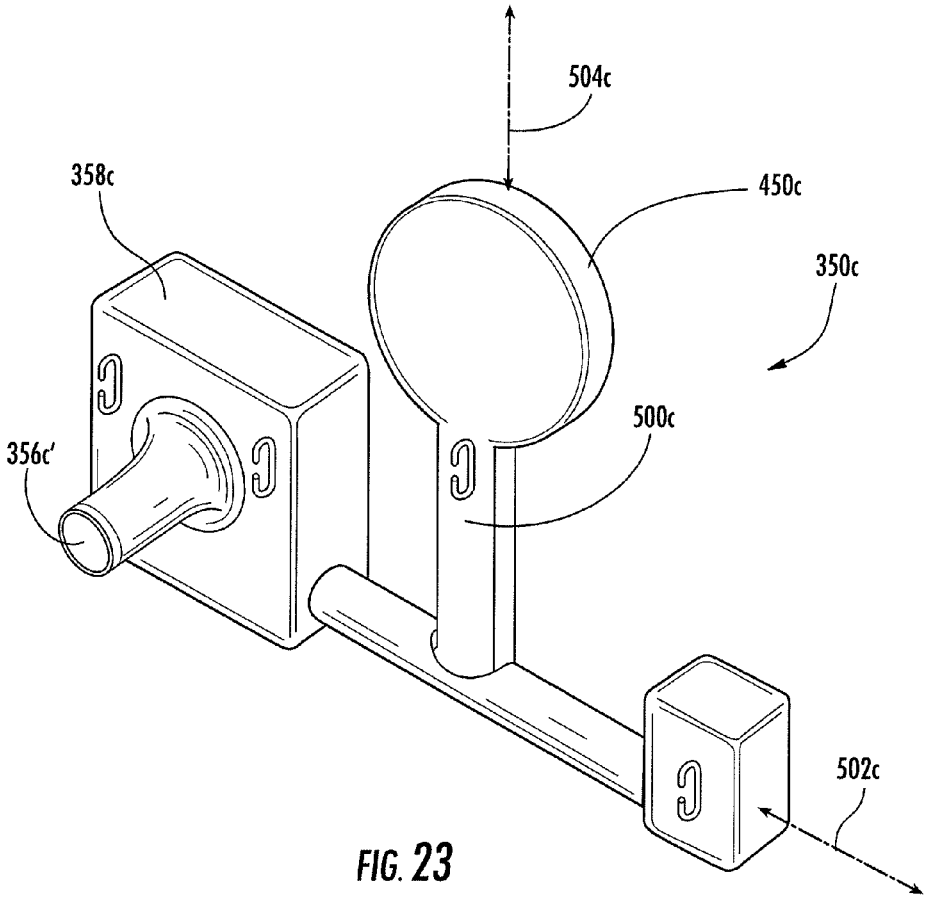

However, particular embodiments of arms and other features which may be associated with various embodiments of the fluid circulation arrangement will now be discussed. In this regard, FIGS. 21-23 illustrate a third embodiment of a fluid circulation arrangement 100*c* comprising an arm 500*c*. In the illustrated embodiment the spray assembly 350*c* is coupled to the rack 13 so as to be supported thereby. For example, the spray assembly 350*c* may be coupled to the sidewall 13" and/or the bottom 13' of the rack 13. In this regard, a base member 358*c* of the spray assembly 350*c* may be coupled to the rack 13, for example using the above-described attachment assemblies. The fluid circulation arrangement 100*c* may include a fluid connector such as the releasable fluid connector described above. In this regard a releasable first connector 356*c*' is illustrated extending from the base member 358*c* in FIG. 23 which may engage a second connector coupled to a dishwashing fluid supply channel to provide fluid communication with the spray assembly 350*c*. In other embodiments the spray assembly may be coupled to a dishwashing fluid supply channel such as the main dishwashing fluid supply channel 300 so as to be supported thereby. Regardless, however, the arm 500*c* may be moveable with respect to the rack 13.

In particular, in the embodiment illustrated in FIGS. 21-23, the arm 500*c* is moveable between a first position wherein the arm 500*c* is adjacent the sidewall 13" of the rack 13 (see, e.g. FIG. 21) and a second position wherein the arm 500*c* is adjacent the bottom 13' of the rack 13 (see the rotated position of the arm 500*c* illustrated in FIG. 22). In the first position, as illustrated in FIG. 21, the nozzle members 400*c* may be directed substantially horizontally, whereas in the second position the nozzle members 400*c* may be directed substantially vertically, as illustrated in FIG. 22. Thus, the arm 500*c* may be configured to rotate about an axis 502*c* between the first and second positions. However, the arm 500*c* may also be configured to rotated about a second axis 504*c*, which may be substantially perpendicular to the axis 502*c* (i.e. the first axis), such that the nozzle member 400*c* may be directed towards or away from the rack 13 in at least one of the first position and the second position.

Various other embodiments of arms which may be used in fluid circulation arrangements are illustrated in FIGS. 24-30. The arms may comprise many of the features described above, and hence not all features of the arms will be described in detail for purposes of brevity. For example, FIGS. 24A-B illustrate a fourth embodiment of a fluid circulation arrangement 100*d*. In this embodiment the arm 500*d* may be configured to rotate about an axis 506*d* whereby the arm 500*d* and nozzle head 450*d* remain adjacent to the bottom 13' of the rack 13. Further, the arm 500*d* may comprise an extensible section 508*d* which is configured to extend or retract the length of the arm 500*d*. Thereby, as illustrated in FIG. 24B, the arm 500*d* may position the nozzle head 450*d* and thus the nozzle member 400*d* in a variety of positions within an intensified wash area 510*d* to provide an intensified wash effect at a desired location. Further, when an intensified wash effect is not needed, the arm 500*d* may be positioned proximate the side wall 13" so as to not be in the way of dishware in the rack 13.

A fifth embodiment of the fluid circulation arrangement 100*e* is illustrated in FIG. 25. The fluid circulation arrangement 100*e* in this embodiment comprises two arms 500*e* which are rotatable about an axis 502*e* between a first position adjacent the sidewall 13" of the rack and a second position adjacent the bottom 13' of the rack. This embodiment of the fluid circulation arrangement 100*e* differs from the above-described embodiments at least in that the arm 500*e* is configured to releasably engage the base member 358*e* in the first position. For example, the arm 500*e* which is to the right as illustrated in FIG. 25 is engaged with the base member 358*e*. Specifically, the nozzle head 450*e* and/or the arm 500*e* may form an interference fit with the base member 358*e*. Thereby, the arm 500*e* may be coupled to the base member 358*e* adjacent to the sidewall 13" of the rack 13 and, in one embodiment, the base member 358*e* may define a substantially planar surface in the first position. By defining a planar surface proximate the sidewall 13" of the rack 13, the spray assembly 350*e* may substantially avoid intruding into the space in the rack 13 where the dishware is placed. In some embodiments the base member 358*e* may define the sidewall of the rack 13 when coupled thereto, or the sidewall may be configured such that the arm 500*e* directly engages the sidewall (or is otherwise positioned adjacent thereto) and the base member is therefore unnecessary. Thereby, in other embodiments the arm 500*e* may additionally or alternatively engage the sidewall 13" of the rack 13.

Additionally, the arm 500*e* may define a bend 510*e*. The bend 510*e* may be configured to direct the nozzle member 400*e* away from a center of the bottom 13' of the rack 13 in the second position. Thereby, for example, the two arms 500*e* may be directed by respective opposite bends 510*e* to position the nozzle heads 450*e* such that they dispense dishwashing fluid in two different intensified wash zones. It is understood that the arm 500*e* may be other sizes and configurations in additional embodiments, such as arms that are straight, curved, or extending at various bend angles.

Further, the fluid circulation arrangement 100*e* may comprise a valve configured to control the supply of dishwashing fluid to the nozzle member 400*e*. In one embodiment the valve may be configured to be closed when the arm 500*e* is in the first position (i.e. the arm 500*e* to the right in FIG. 25) and open when the arm 500*e* is in the second position (i.e. the arm 500*e* to the left in FIG. 25). Thereby the nozzle member 400*e* may automatically receive dishwashing fluid when in the second position wherein the nozzle member 400*e* is directed vertically or in other directions which point toward the dishware. Various types and embodiments of valves may be employed for this purpose as may be understood by one having skill in the art, and hence the valve will not be discussed in detail.

A sixth embodiment of the fluid circulation arrangement 100*f* is illustrated in FIG. 26. The fluid circulation arrangement 100*f* may comprise an arm 500*f* which rotates about an axis 502*f* between a first position adjacent the sidewall 13" of the rack 13 and a second position adjacent the bottom 13' of the rack 13. As with the fifth embodiment of the fluid circulation arrangement 100*e*, the spray assembly 350*f* may be configured to releasably engage the base member 358*f* in the first position and define a planar surface, as the arm 500*f* is illustrated to the right in FIG. 26, and a valve may be configured to be closed in the first position such that the nozzle member 400*f* does not receive dishwashing fluid in the first position. Thus, the sixth embodiment of the fluid circulation arrangement 100*f* is similar to the fifth embodiment of the fluid circulation system with the exception that the arm 500*f* is substantially straight and the arm 500*f* extends above the base member 358*f* in the first position. However, various other embodiments of arms may be used in other embodiments.

A seventh embodiment of the fluid circulation arrangement 100*g* is illustrated in FIG. 27, which may be similar to the fluid circulation arrangement 100*f* illustrated in FIG. 26. However, the fluid circulation arrangement 100*g* illustrated in FIG. 27 employs a flexible hose 252*g* or similar conduit to supply the dishwashing fluid to the spray assembly 350*g*. As described above, the flexible hose 252*g* may be used in place of a releasable connector in embodiments in which the spray assembly 350*g* is coupled to the rack 13.

An eighth embodiment of the fluid circulation arrangement 100*h* is illustrated in FIGS. 28-30. The fluid circulation arrangement includes a spray assembly 350*h*. The spray assembly includes a base member 358*h* which may include attachment members such as the illustrated clips 352*h* which may attach the spray assembly 350*h* to the sidewall 13" of the rack 13 and/or other portion of the rack 13 such as the base portion 13'. A first releasable connector 356*h'* may extend from the base member 358*h* and be configured to engage a dishwashing fluid supply channel such as the main dishwashing fluid supply channel 300, as described above.

A plurality of nozzle heads 450*h* are mounted on arms 500*h* which extend from the base member 358 and which are rotatable about an axis 502*h* between a first position adjacent the sidewall 13" of the rack 13 and a second position adjacent the bottom 13' of the rack 13. The arms 500*h* are further rotatable about a second axis 504*h*, which may be substantially perpendicular to the axis 502*h* (i.e. the first axis), such that the nozzle members 400*h* may be directed towards or away from the rack 13 in the first position and/or the second position. Thus, the nozzle members 400*h* may be directed toward the dishware if so desired in both the first and second positions in some embodiments as illustrated in FIGS. 29 and 30, respectively. In one embodiment, the nozzle members 400*h* could also or alternatively be configured to pivot or rotate to orient itself with respect to the rack and direct water toward the dishware. In some embodiments the fluid circulation arrangement 100*h* may include a valve which is configured to be open when the nozzle members 400*h* are directed toward the dishware and configured to be closed when the nozzle members 400*h* are directed away from the dishware.

The arms 500*h* may respectively comprise a first section 500*h'* configured to rotate about the first axis 502*h* and a second section 500*h"* configured to rotate about the second axis 504*h*. Thereby, the first section 500*h'* of the arm 500*h* may connect the second section 500*h"* of the arm 500*h* to the base member 358*h* which may comprise the dishwashing fluid supply conduit 250*h* and hence act as a manifold which supplies the dishwashing fluid to the arms 500*h*. In some embodiments the first section 500*h'* of the arm 500*h* may comprise a right-angle member, and the second section 500*h"* of the arm 500*h* may comprise a Y-shaped member which distributes the washing fluid to two nozzle heads 450*h* per arm, so as to provided an intensified washing effect at multiple areas within the dishwasher. However, various other embodiments of the spray assembly may be provided in other embodiments as may be understood by one having skill in the art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher comprising:

a tub;

a rack configured to be positioned within the tub, wherein the rack defines a bottom of the rack and at least one sidewall that extends upwardly from the bottom of the rack, the rack adapted to receive dishware therein;

a dishwashing fluid supply channel configured to supply a dishwashing fluid;

a spray arm positioned below the rack, wherein the spray arm is configured to receive the dishwashing fluid and to dispense the dishwashing fluid; and a spray assembly directly coupled to the sidewall of the rack, the spray assembly comprising at least one nozzle member adapted to receive the dishwashing fluid from the dishwashing fluid supply channel and to dispense the dishwashing fluid therefrom into an intensified wash zone, the spray assembly comprising a manifold coupled to the sidewall and a plurality of nozzle members coupled thereto, wherein the manifold is positioned adjacent to the sidewall such that the nozzle members extend at least partially through the sidewall; and wherein the dishwashing fluid dispensed from the spray arm is incident on the intensified wash zone from a different direction than the dishwashing fluid dispensed from the spray assembly.

2. The dishwasher of claim 1, wherein the spray assembly further comprises at least one attachment member configured to couple the spray assembly to the sidewall of the rack.

3. The dishwasher of claim 1, wherein the spray assembly further comprises a fluid connector configured to couple the spray assembly to the dishwashing fluid supply channel so as to provide fluid communication therebetween.

4. The dishwasher of claim 3, wherein the rack is moveable between a loading position at which the spray assembly is decoupled from the dishwashing fluid supply channel and an operating position at which the spray assembly is coupled to the dishwashing fluid supply channel.

5. The dishwasher of claim 1, further comprising a valve configured to control supply of the dishwashing fluid to the nozzle member.

6. The dishwasher of claim 1, wherein the spray assembly further comprises a second arm coupled to the nozzle member.

7. The dishwasher of claim 6, wherein the second arm is moveable with respect to the rack.

8. The dishwasher of claim 7, wherein the second arm is configured to rotate about a first axis between a first position wherein the nozzle member is directed substantially horizontally and a second position wherein the nozzle member is directed substantially vertically.

9. The dishwasher of claim 8, wherein the second arm comprises a bend configured to direct the nozzle member away from a center of the bottom of the rack in the second position.

10. The dishwasher of claim 8, further comprising a valve configured to control the supply of dishwashing fluid to the nozzle member, wherein the valve is configured to be closed when the second arm is in the first position and open when the second arm is in the second position.

11. The dishwasher of claim 8, wherein the second arm is further configured to rotate about a second axis which is substantially perpendicular to the first axis such that the nozzle member may be directed towards or away from the rack in at least one of the first position or the second position.

12. The dishwasher of claim 11, wherein the second arm comprises a first section configured to rotate about the first axis and a second section configured to rotate about the second axis.

13. The dishwasher of claim 8, wherein the spray assembly comprises a plurality of second arms each rotatable with respect to the rack about the first axis and each comprising at least one respective nozzle member.

14. The dishwasher of claim 6, wherein the second arm is Y-shaped.

15. The dishwasher of claim 1, wherein the spray arm is configured to receive the dishwashing fluid and to dispense the dishwashing fluid in a first wash zone, and wherein the spray assembly is configured to dispense the dishwashing fluid in a second wash zone, wherein the second wash zone differs from the first wash zone in at least one of position or intensity.

16. The dishwasher of claim 1, wherein the spray assembly is coupled to the sidewall of the rack so as to be supported thereby.

17. The dishwasher of claim 15, wherein the second wash zone corresponds to a designated area of the rack, and wherein at least a portion of the rack is configured to indicate the location of the designated area.

18. A method of assembling a dishwasher comprising:

providing a dishwasher, the dishwasher comprising:

a tub;

a rack configured to be positioned within the tub, wherein the rack defines a bottom of the rack and at least one sidewall that extends upwardly from the bottom of the rack, the rack adapted to receive dishware therein;

a dishwashing fluid supply channel configured to supply a dishwashing fluid; and a spray arm positioned below the rack, wherein the spray arm is configured to receive the dishwashing fluid and to dispense the dishwashing fluid; and directly coupling a spray assembly to the sidewall of the rack so as to be supported thereby, the spray assembly comprising at least one nozzle member adapted to receive the dishwashing fluid from the dishwashing fluid supply channel and to dispense the dishwashing fluid therefrom into an intensified wash zone, the spray assembly comprising a manifold coupled to the sidewall and a plurality of nozzle members coupled thereto, wherein the manifold is positioned adjacent to the sidewall such that the nozzle members extend at least partially through the sidewall; and wherein the dishwashing fluid dispensed from the spray arm is incident on the intensified wash zone from a different direction than the dishwashing fluid dispensed from the spray assembly.

19. The method of claim 18, wherein the at least one spray arm defines a spray arm fluid connector configured to couple the at least one spray arm to the dishwashing fluid supply channel to provide fluid communication therebetween, wherein the at least one spray arm is configured to direct dishwashing fluid into the tub, wherein the spray assembly further comprises a spray assembly fluid connector configured to couple the spray assembly to the dishwashing fluid supply channel so as to provide fluid communication therebetween, and wherein the spray assembly fluid connector is spaced apart from the spray arm fluid connector such that there is no direct fluid communication between the at least one spray arm and the spray assembly.

20. The method of claim 18, wherein the spray arm is configured to receive the dishwashing fluid and to dispense the dishwashing fluid in a first wash zone, and wherein the spray assembly is configured to dispense the dishwashing fluid in a second wash zone, wherein the second wash zone differs from the first wash zone in at least one of position or intensity.

21. The method of claim 20, wherein the second wash zone corresponds to a designated area of the rack, and wherein at least a portion of the rack is configured to indicate the location of the designated area.

22. A dishwasher comprising:

a tub;

a rack configured to be positioned within the tub, wherein the rack defines a bottom of the rack and at least one sidewall that extends upwardly from the bottom of the rack, the rack adapted to receive dishware therein;

a dishwashing fluid supply channel configured to supply a dishwashing fluid;

a spray arm positioned below the rack, wherein the spray arm is configured to receive the dishwashing fluid and to dispense the dishwashing fluid; and a spray assembly directly coupled to the sidewall of the rack, the spray assembly comprising at least one nozzle member adapted to receive dishwashing fluid from the dishwashing fluid supply channel and to dispense the dishwashing fluid therefrom into an intensified wash zone, wherein the at least one spray arm defines a spray arm fluid connector configured to couple the at least one spray arm to the dishwashing fluid supply channel to provide fluid communication therebetween, wherein the at least one spray arm is configured to direct dishwashing fluid into the tub, wherein the spray assembly further comprises a spray assembly fluid connector configured to couple the spray assembly to the dishwashing fluid supply channel so as to provide fluid communication therebetween, and wherein the spray assembly fluid connector is spaced apart from the spray arm fluid connector such that there is no direct fluid communication between the at least one spray arm and the spray assembly and wherein the dishwashing fluid dispensed from the spray arm is incident on the intensified wash zone from a different direction than the dishwashing fluid dispensed from the spray assembly.

* * * * *